US010570638B2

(12) United States Patent
Clark et al.

(10) Patent No.: US 10,570,638 B2
(45) Date of Patent: Feb. 25, 2020

(54) SHELTERS AND TEAM SHELTERS HAVING A REPOSITIONABLE CANOPY

(71) Applicant: Sportsfield Intellectual, LLC, Delhi, NY (US)

(72) Inventors: Sean R. Clark, Delhi, NY (US); Andrew P. Hannigan, Delhi, NY (US); Eric W. Hulbert, Delhi, NY (US)

(73) Assignee: SPORTSFIELD INTELLECTUAL, LLC, Delhi, NY (US)

( * ) Notice: Subject to any disclaimer, the term of this patent is extended or adjusted under 35 U.S.C. 154(b) by 0 days.

(21) Appl. No.: 16/043,397

(22) Filed: Jul. 24, 2018

(65) Prior Publication Data

US 2020/0032542 A1 Jan. 30, 2020

(51) Int. Cl.
*E04H 15/58* (2006.01)
*A47C 7/66* (2006.01)
(Continued)

(52) U.S. Cl.
CPC ..... *E04H 15/18* (2013.01); *A47C 7/666* (2018.08); *E04H 15/48* (2013.01); *E04H 15/54* (2013.01); *E04H 15/58* (2013.01)

(58) Field of Classification Search
CPC ..... E04H 15/02; E04H 15/18; E04H 15/58; A47C 7/66; A47C 7/666
See application file for complete search history.

(56) References Cited

U.S. PATENT DOCUMENTS

D198,565 S 7/1964 Cooper
3,155,427 A * 11/1964 Necessary ..... A47C 1/16 135/149

(Continued)

FOREIGN PATENT DOCUMENTS

DE 2725910 A1 * 12/1978 ..... A47C 1/14
DE 2921868 A1 12/1980

(Continued)

OTHER PUBLICATIONS

Team Shelter available from Soccer Innovations of Dallas, Texas, printout on Jun. 26, 2018, available at https://soccerinnovations.com/team-shelter-mvp-stadium-sports-shelter-bench-cover/, 3 pages, at least as early as Jun. 14, 2018.

(Continued)

*Primary Examiner* — Noah Chandler Hawk
(74) *Attorney, Agent, or Firm* — Heslin Rothenberg Farley and Mesiti PC

(57) ABSTRACT

A shelter such as a team shelter includes, for example, a frame structure having left and right frames, and a canopy. The canopy is positionable in a first position with a front portion of the canopy disposed at a first elevation between front portions of the left and right frames so that the front portion of the canopy, and front portions of the left and right frames to define a front facing opening allowing access by one or more people into the shelter and under the canopy. The canopy is positionable in a second position with the front portion of the canopy disposed at a second lower elevation relative to the left and right frames so that the canopy disposed in the second position results in the shelter being less susceptible to wind induced tip over compared to the shelter with the canopy disposed in the first position.

33 Claims, 20 Drawing Sheets

(51) Int. Cl.

| | |
|---|---|
| ***E04H 15/18*** | (2006.01) |
| ***E04H 15/48*** | (2006.01) |
| *E04H 15/54* | (2006.01) |

(56) References Cited

U.S. PATENT DOCUMENTS

| | | | | |
|---|---|---|---|---|
| 3,745,305 | A | 7/1973 | Reed et al. | |
| 3,762,109 | A * | 10/1973 | Cohen | E04H 1/1211 52/11 |
| 3,858,643 | A | 1/1975 | Reed et al. | |
| 4,096,874 | A | 6/1978 | Weatherly | |
| 4,201,416 | A * | 5/1980 | Vanderminden | A47C 7/66 297/184.15 |
| 5,015,032 | A * | 5/1991 | Felling | A47C 1/0242 297/184.15 |
| 5,363,608 | A | 11/1994 | Conlan | |
| 6,244,286 | B1 | 6/2001 | Russo | |
| 7,331,880 | B2 | 2/2008 | Rogers | |
| 7,527,569 | B2 | 5/2009 | Rogers | |
| 8,172,705 | B2 | 5/2012 | Rogers | |
| 8,777,784 | B2 | 7/2014 | Rogers | |
| 2016/0339314 | A1 | 11/2016 | Parsons | |

FOREIGN PATENT DOCUMENTS

| | | | | |
|---|---|---|---|---|
| DE | 19607271 | A1 * | 8/1997 | A47C 1/14 |
| DE | 10317630 | B3 * | 10/2004 | A47C 1/14 |
| FR | 2686639 | A1 * | 7/1993 | E04H 1/1205 |

OTHER PUBLICATIONS

Portable Soccer Team Shelter Cover available from quickplaysport.us, printout on Jun. 26, 2018, available at http://quickplaysport.us/seating-shelters/sports-shelters/cover.html, (Wayback Verification Crawl presence dated Sep. 20, 2017) 6 pages, at least as early as Sep. 20, 2017.

Kwik Goal Shelter, product No. 9B531, available from Kwik Goal Ltd. of Quakertown, Pennsylvania, printout on Jun. 27, 2018, available at http://www.kwikgoal.com/product/9B531/Custom-Shelter-w-Bench-and-Wheels, (Wayback Verification Crawl presence dated Mar. 18, 2016) 10 pages, at least as early as Mar. 18, 2016.

* cited by examiner

SHELTERS AND TEAM SHELTERS HAVING A REPOSITIONABLE CANOPY

FIELD OF THE DISCLOSURE

The present disclosure relates generally to a shelters, and in particular to team shelters having a repositionable canopy.

BACKGROUND

Team shelters used at football, soccer, hockey, field meets, lacrosse and other games and sporting events are typically disposed along the sidelines to protect players, coaches, and other participants from the wind, inclement weather, and the sun. The team shelters are generally fully enclosed on three sides and are typically positionable over a bench or a plurality of chairs. The seating is most commonly integral to and part of the team shelter.

Most team shelters are portable/free-standing team shelters, with a majority being rigid structures supporting polycarbonate panels or similar panels. A majority of portable/free-standing team shelters include castors for transport. Some team shelters are rigid and secured in place using concrete. Other less prevalent team shelters include fabric coverings in lieu of the polycarbonate panels, and some of the fabric-covered team shelters are collapsible and/or have a pop-up configuration like a camping chair.

SUMMARY

Shortcomings of the prior art are overcome and additional advantages are provided through the provision, in one embodiment, of a shelter having, for example, a frame structure defining a left frame and a spaced-apart right frame, and a canopy. The canopy is positionable in a first position with a front portion of the canopy disposed at a first elevation between a front portion of the left frame and a front portion of the right frame so that the front portion of the canopy, the front portion of the left frame, and the front portion of the right frame define a front facing opening allowing access by one or more people into the shelter and under the canopy. The canopy is positionable in a second position with the front portion of the canopy disposed at a second lower elevation relative to the left frame and the right frame so that the canopy disposed in the second position results in the shelter being less susceptible to wind induced tip over compared to the shelter with the canopy disposed in the first position.

In another embodiment, a method includes, for example, providing the above-noted shelter with the canopy positioned in the first position, and moving the canopy to the second position.

In another embodiment, a team shelter includes, for example, a frame structure having a left frame, a right frame, and an elongated rear frame extendable between the left frame and the right frame, an elongated bench attachable between the left frame and the right frame, and an elongated canopy. The elongated canopy is positionable in a raised orientation with a lower elongated portion of the elongated canopy extending from an upper portion of the elongated rear frame of the frame structure, a middle elongated portion of the elongated canopy disposed over the elongated bench, and an upper elongated portion of the canopy extending above the bench so that the upper portion of the elongated canopy, a front portion of the left frame, and a front portion of the right frame define a front facing opening having a vertical plane allowing access by one or more athletes to the elongated bench. The elongated canopy is pivotally movable to a lowered orientation with the lower elongated portion of the elongated canopy extending from the upper portion of the elongated rear frame and the upper elongated portion of the elongated canopy extending below a front portion of the bench and extending adjacent to the ground.

In another embodiment, a method includes, for example, providing the above-noted shelters with the canopy positioned in the raised orientation, and moving the canopy to the lowered orientation.

In another embodiment, a method includes, for example, positioning a canopy of a shelter in a first position at a first elevation above a bench or a plurality of seats to define a front facing opening allowing access by one or more people to the bench or a plurality of seats, and repositioning the canopy in a second position at a second elevation different from the first elevation so that the shelter is less susceptible to wind induced tip over compared to the shelter with the canopy disposed in the first position.

In another embodiment, a method includes, for example, positioning a canopy of a shelter in a first position at a first elevation above a bench to define a front facing opening allowing access by one or more people to the bench or a plurality of seats, pivoting the canopy to a second position at a second elevation different from the first elevation, and locking the canopy in the second position so that the shelter is less susceptible to wind induced tip over compared to the shelter with the canopy disposed in the first position.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

The present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific examples, while indicating embodiments of the present disclosure, are given by way of illustration only, and are not by way of limitation. Various substitutions, modifications, additions and/or arrangements within the spirit and/or scope of the underlying concepts will be apparent to those skilled in the art from this disclosure. Reference is made below to the drawings, which are not drawn to scale for ease of understanding, wherein the same reference numbers used throughout different figures designate the same or similar components.

The present disclosure is directed to shelters such as three sided shelters for protection of one or more people from, for example, the wind, inclement weather, and the sun. Such shelter may be a team shelter having a bench that provide protection to athletics during sporting events. As described below, a shelter may include a repositionable canopy that allows protection of the shelter when not in use and also reduces the likelihood of the shelter tipping over in high winds. The shelter may be generally enclosed on three sides with a bottom portion of the shelter uncovered to reduce the likelihood of the shelter tipping when in use during high winds. As will be appreciated from the description below, the present disclosure for shelters such as portable/free-standing shelters having a rigid frame and polycarbonate-like enclosure panels and/or fabric coverings, overcomes the problem of wind-related tip-overs, and thus, reduces the likelihood of costly damage and repair.

Figure 1:
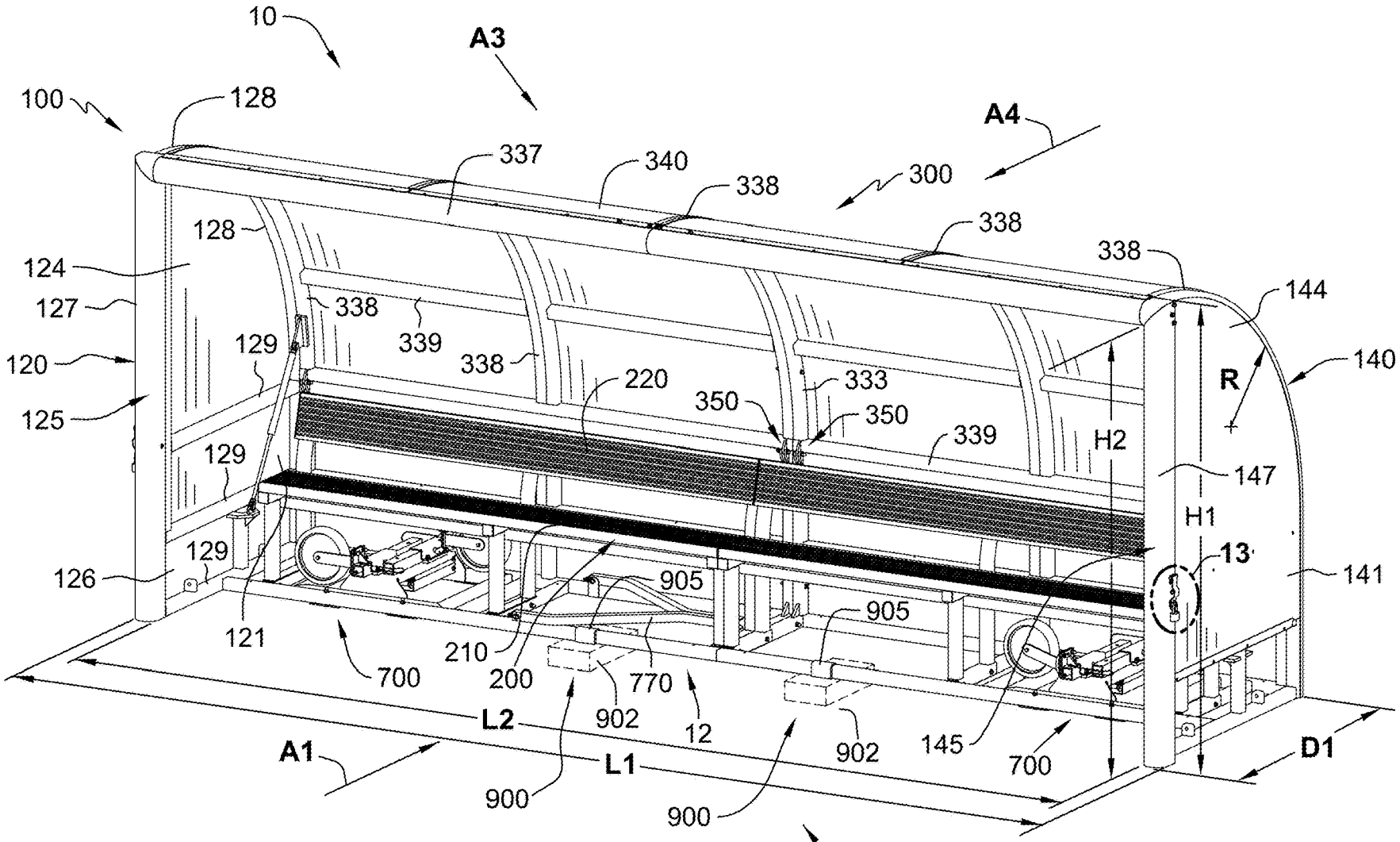
FIG. 1 is a front perspective view of a shelter having a repositionable canopy according to an embodiment of the present disclosure with the canopy positioned in a raised orientation.

FIG. 1 illustrate a shelter 10 such as a team shelter according to an embodiment of the present disclosure. In this illustrated embodiment, shelter 10 may generally include an elongated frame structure 100, an elongated bench 200, and an elongated canopy 300. As shown in FIG. 1, shelter 10 may be disposed on level ground with a pair of mobility devices 700 disposed in an upright stored position. In some embodiments, the shelter may not have an integral bench but allow placing a bench or a plurality of chairs therein during use of the shelter.

Figure 2:
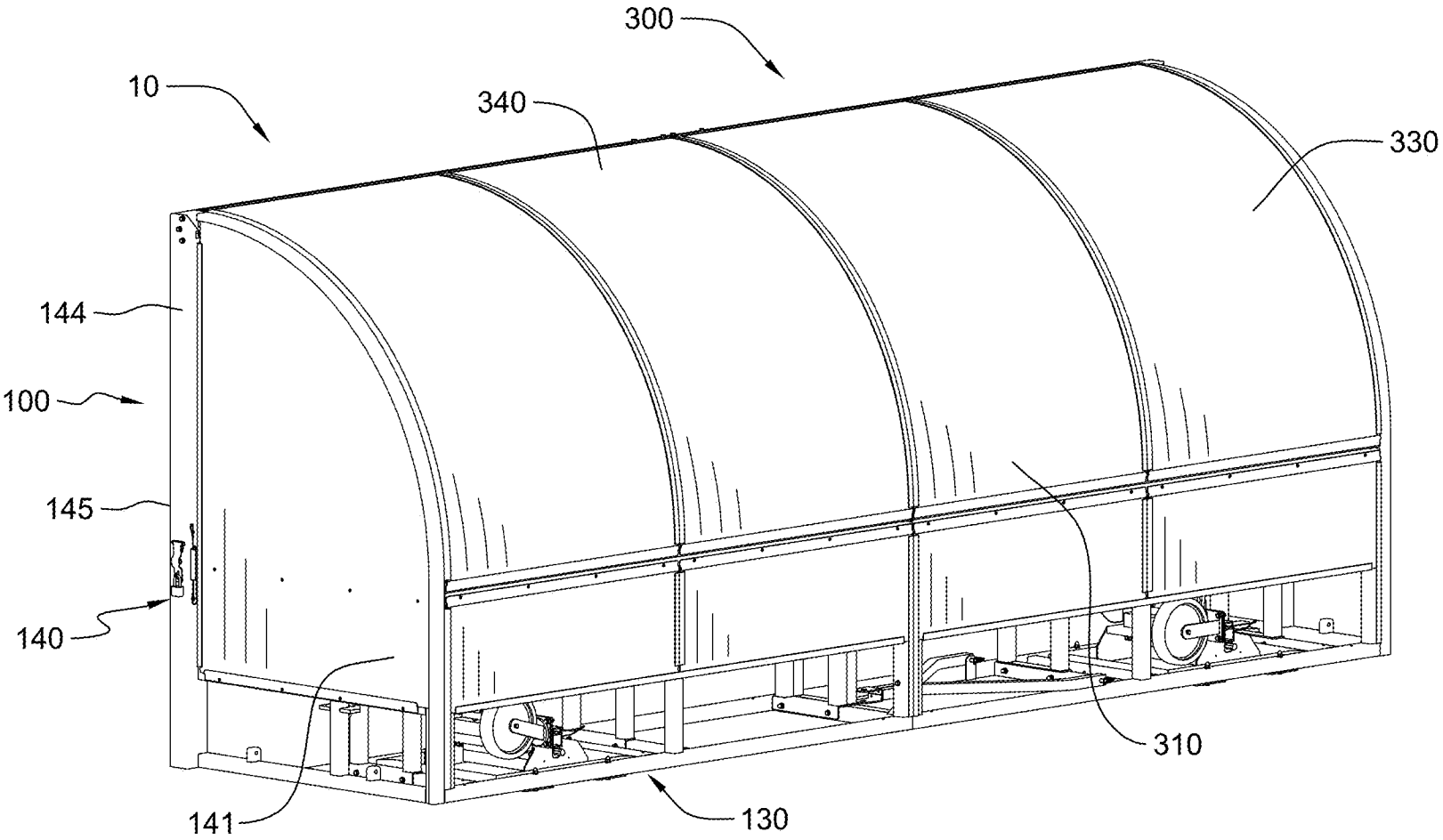
FIG. 2 is a rear perspective view of the shelter of FIG. 1.
Figure 3:
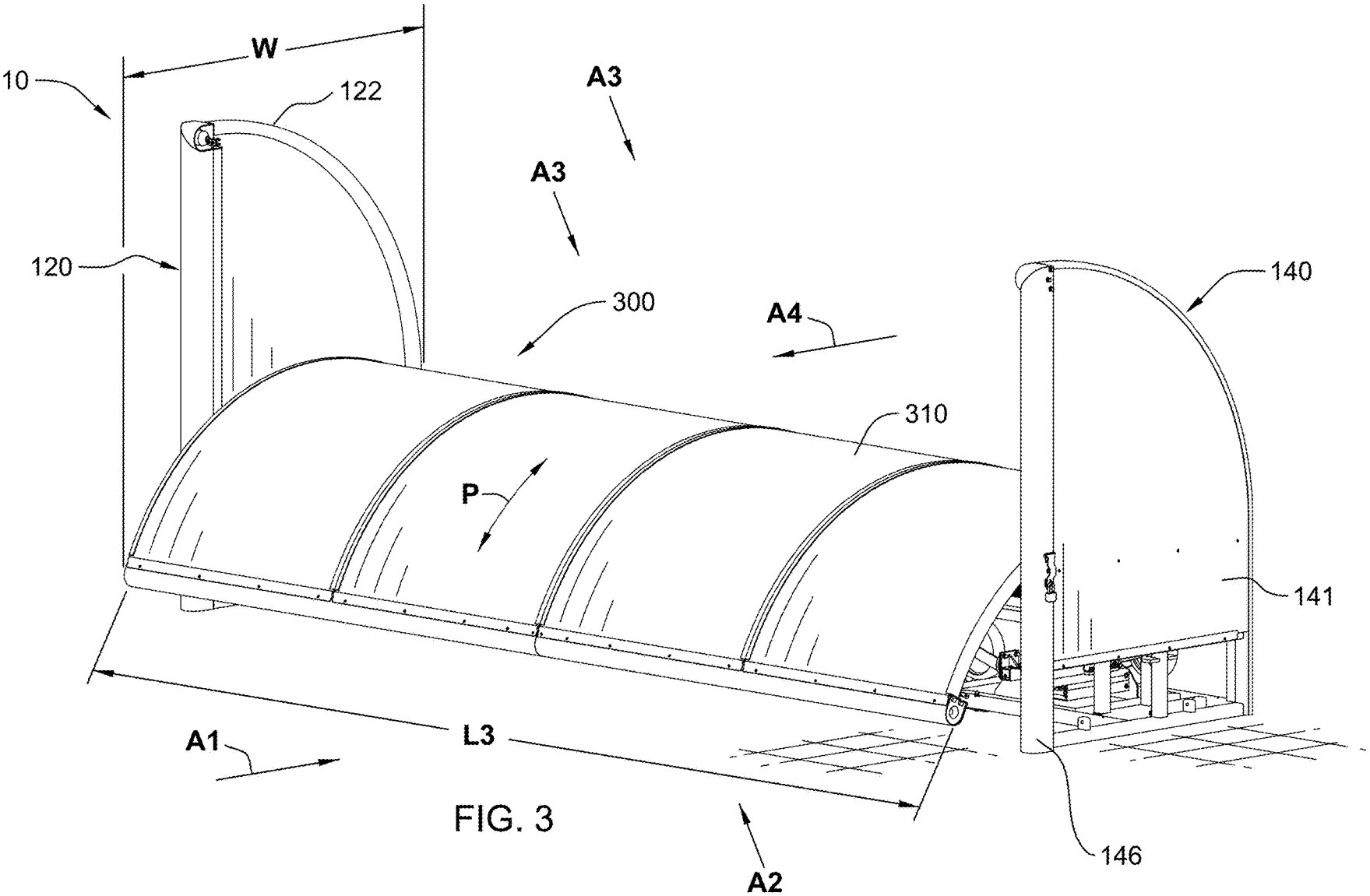
FIG. 3 is a front perspective view of the shelter of FIG. 1 with the repositionable canopy positioned in a lowered orientation.
Figure 4:
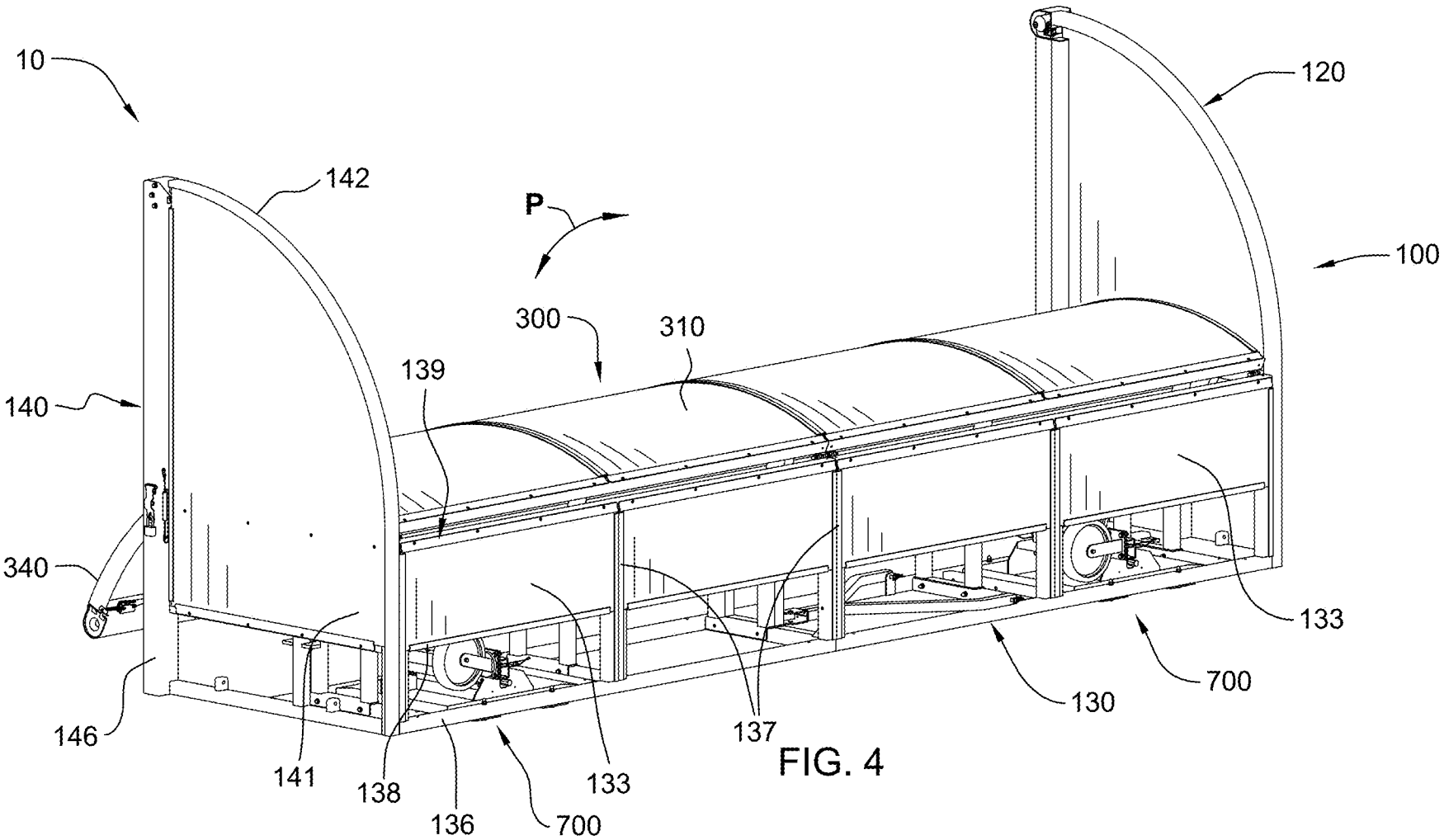
FIG. 4 is a rear perspective view of the shelter of FIG. 3.

As shown in FIGS. 1 and 2, shelter 10 is positioned in a usable configuration with elongated canopy 300 positioned in a raised orientation for protecting one of more people such as athletes during a sporting event from the sun, rain, and wind. As shown in FIGS. 3 and 4, shelter 10 is positionable in a stored or unused configuration with elongated canopy 300 movably repositioned to a lowered orientation. For example, elongated canopy 300 may be movable in the directions upwardly and downwardly as illustrated by double curved arrow P. In the stored configuration, shelter 10 is configured to reduce the likelihood of tipping over due to high winds, protect bench 200 (FIG. 1) and mobility devices 700 (FIG. 4) from the sun, rain, or winds, as well as inhibit unauthorized use of the shelter by others.

With reference again to FIGS. 1 and 2, frame structure 100 may include a left frame 120 (FIG. 1) and a spaced-apart right frame 140. Elongated canopy 300 is extendable between left frame 120 and right frame 140. Elongated canopy 300 is positionable in the raised orientation with a lower elongated rear portion 310 (FIG. 2) of elongated canopy 300 disposed between a lower rear portion 121 (FIG. 1) of left frame 120 and a lower rear portion 141 of right frame 140, and with an upper elongated portion 340 of canopy 300 disposed between an upper front portion 124 (FIG. 1) of left frame 120 and an upper front portion 144 of right frame 140 so that upper portion 340 of elongated canopy 300, a front portion 125 (FIG. 1) of left frame 120, and a front portion 145 of right frame 140 define a front facing opening 12 allowing access by users such as athletes into shelter 10. As illustrated in FIG. 1, front facing opening 12 may be a planar opening disposed along a vertical plane.

With reference again to FIGS. 3 and 4, elongated canopy 300 is also repositionable in the lowered orientation with lower elongated rear portion 310 of elongated canopy 300 disposed between lower rear portion 121 (FIG. 1) of left frame 120 (FIG. 3) and a lower rear portion 141 of right frame 140, with upper elongated portion 340 of elongated canopy 300 disposed between a lower front portion 126 (FIG. 1) of left frame 120 and a lower front portion 146 of right frame 140, and with upper elongated portion 340 of elongated canopy 300 extending forward of lower front portion 126 (FIG. 1) of left frame 120 and lower front portion 146 of right frame 140 so that the shelter in the second orientation is less susceptible to wind induced tip over compared to the shelter disposed in the first orientation. In some embodiments, access by users, e.g., as athletes, into shelter 10 may be inhibited. In some embodiments, elongated canopy 300 is positionable in the lowered orientation with upper elongated portion 340 of elongated canopy 300 extending adjacent to or in contact with the ground as shown in FIG. 3.

As shown in FIGS. 1 and 3, for example, left frame 120 and right frame 140 may have generally planar configurations that are spaced apart and parallel to each other. In addition, left frame 120 and right frame 140 may be disposed perpendicularly or at right angles to canopy 300 and to vertical planar opening 12 (FIG. 1). As illustrated in FIG. 1, shelter 10 has a front entrance opening or a front vertical planar opening defining a first size or first area that opens onto a space or volume in the shelter, which space or volume is generally surrounded on the left, right, rear, top, and by the ground. Forces on shelter 10 may depend on wind speed and direction, some of such directions being illustrated in FIGS. 1 and 3 as arrow A1, arrow A2, arrow A3, and arrow A4. Air resistance by the shelter to the wind creates a force on the shelter, which may act to lift and/or tip over the shelter.

As shown in FIG. 3, shelter 10 has a closed front entrance opening that inhibits wind from entering a reduced space or reduced volume in the shelter, which space or volume being generally surrounded on the left, right, rear, top, and by the ground. Given the same wind speed and direction, e.g., directions illustrated as arrow A1, arrow A2, arrow, A3, and arrow A4 in FIG. 1, and illustrated as arrow A1, arrow A2, arrow, A3, and arrow A4 in FIG. 3, the wind will pass over the top of the canopy so that the air resistance will be reduced in the lowered configuration of the shelter shown in FIG. 3 compared the raised configuration of the shelter shown in FIG. 1.

In other operable embodiments, the front of canopy 300 need not rest on the ground in the lowered orientation in order to result in a reduced air resistance and lift compared to when the canopy of the shelter is disposed in raised orientation. For example, a partially lowered canopy, e.g., the front of the canopy being spaced above the ground, will also provide a reduced front entrance opening defining a reduced size or reduced area that opens onto a reduced space or volume in the shelter. Given the same wind speed and direction, e.g., directions illustrated as arrow A1, arrow A2, arrow, A3, and arrow A4 in FIG. 1, a portion of the wind will operably enter the reduced front entrance opening with the remaining portion of the wind will pass over the top of the canopy so that the air resistance will be reduced compared the raised configuration of the shelter shown in FIG. 1.

As will be appreciated, shelter 10 as shown in FIG. 1 has a front entrance opening or a front vertical planar opening defining a first size or first area that opens onto a space in the shelter that is generally surrounded on the left, right, rear, top, and by the ground. Forces on shelter 10 depends on wind speed and direction, some of such directions being illustrated in FIGS. 1 and 3 as arrow A1, arrow A2, arrow, A3, and arrow A4. The wind on the shelter creates a total aerodynamic force, which may be resolved into air resistance and lift. Depending on the alignment of the shelter with the direction of the wind, air resistance or lift may be the predominant component. As will be appreciated, for given wind directions toward shelter 10 as shown in FIG. 1, shelter 10 with the canopy in the raised orientation has a greater vertical profile, side, or elevation plan view normal to the given wind direction compared the vertical profile, side, or elevation plan view normal to the given wind directions of shelter 10 with the canopy disposed in the lowered orientation as shown in FIG. 3.

With reference again to FIG. 1, elongated bench 200 is disposable and may extend between left frame 120 and right frame 140. Elongated bench 200 may be operably attachable to or part of frame structure 100. Elongated bench 200 may include an elongated seat 210 and an elongated back 220.

Frame structure 100 may include a framework of frame members. For example, left frame 120 may include a vertical front post 127, a curved edge member 128, and a plurality of cross members 129. Right frame 140 may be similarly configured. Elongated canopy 300 may include a curved cross-section across the width of elongated canopy 300. Canopy 300 may include a front bar or horizontal front post 337, a plurality of curved members 338, and a plurality of cross members 339.

As shown in FIG. 4, frame structure 100 may include an elongated rear frame 130 disposed and extending between left frame 120 and right frame 140. Elongated rear frame 130 may include a plurality of vertical members 137 and a lower cross member 136, a middle cross member 138, and an upper cross members 139. With reference again to FIGS. 1-4, the right frame, the left frame, and the rear frame of the shelter may remain in the same configuration, e.g. upright configuration with the bottom portions of the left frame, the right frame, and the rear frame disposed on the ground when the canopy is disposed in the raised orientation and when the canopy is disposed in the lowered orientation. For example, the canopy may be moved relative to the upright left frame, upright right frame, and upright rear frame, while the upright left frame, upright right frame, and upright rear frame remaining in a stationary orientation.

Figure 5:
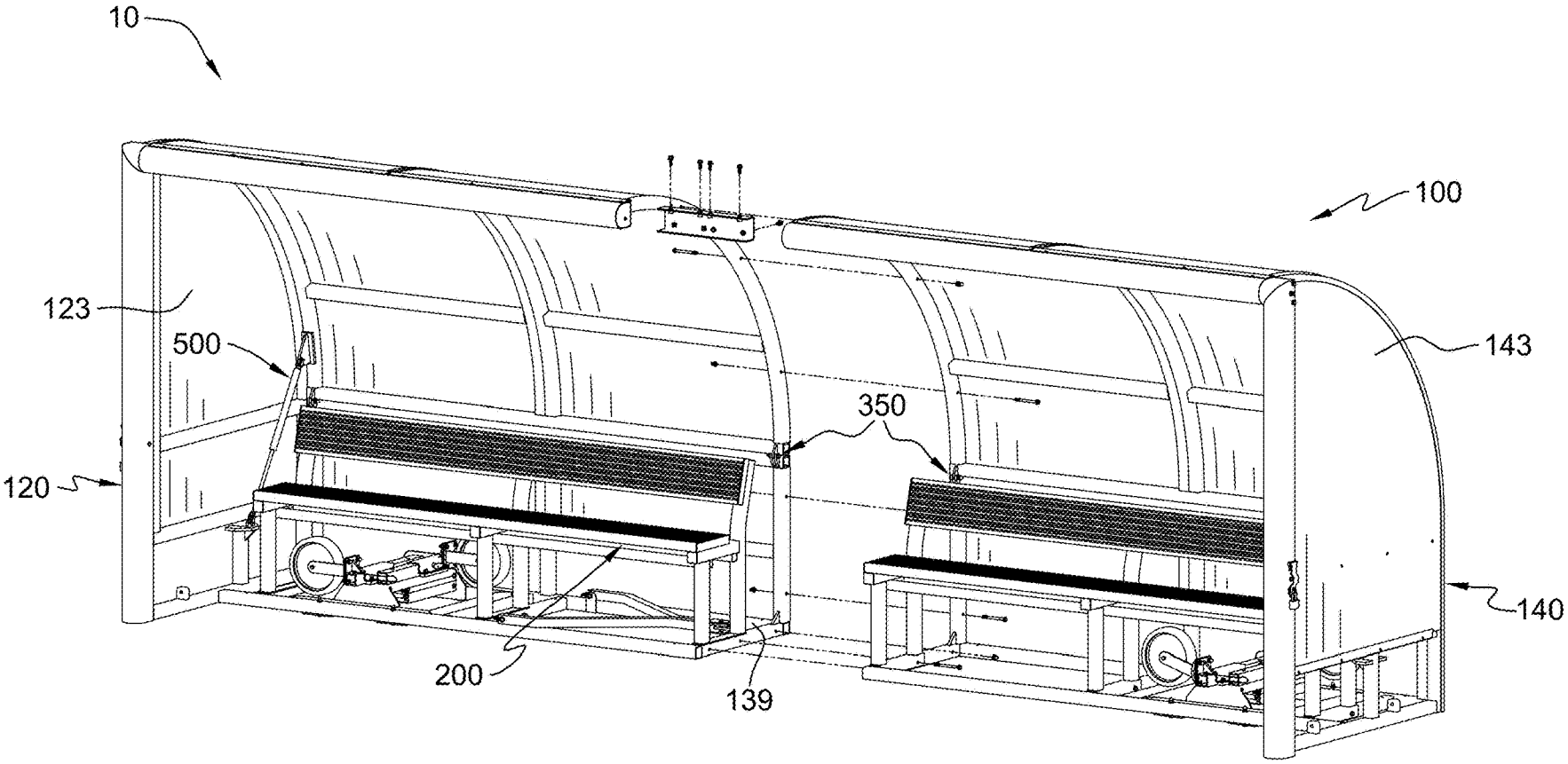
FIG. 5 is a front perspective view, partially exploded, of the shelter of FIG. 1.

With reference to FIG. 5, shelter 10 may be assembled in halves, and the halves operably assembled together with bolts and one or more connecting plates. Left frame 120 may include an operably attached left end panel 123, right frame 140 may include an operably attached right end panel 143, and rear frame 130 (FIG. 4) may include operably attached rear panels 133 (FIG. 4).

Frame structure 100 and bench 200 may be may be formed from a metal material such as aluminum extrusions. The various panels may be formed from a generally rigid solid plastic or polymeric material such as a polycarbonate material. For example, the panels may be a light grey tinted polycarbonate material. The panels may be preinstalled and replaceable if damaged. The panels may include custom vinyl lettering or logos. The panels may extend over the entire frame structure or only over a portion of the frame structure, e.g., may not extend over a lower portion of the frame structure so that the lower portion of the frame structure is open as shown in FIG. 4. In other embodiments, one or more resilient covers may be operably attached to the frame structure and the elongated canopy. The resilient covers may be formed for a fabric material or plastic or polymeric material. In some embodiments, additional ventilation may be provided by pivoting or sliding windows or perforations in the panels or fabric.

With reference again to FIG. 1, left frame 120 may include an outer peripheral edge 122 (FIG. 3) shaped to correspond to a shape of a left edge of elongated canopy 300 when elongated canopy 300 is positioned in the raised orientation, and right frame 140 may include an outer peripheral edge 142 (FIG. 4) shaped to correspond to the shape of a right edge of elongated canopy 300 when elongated canopy 300 is disposed in the raised orientation.

Figure 6:
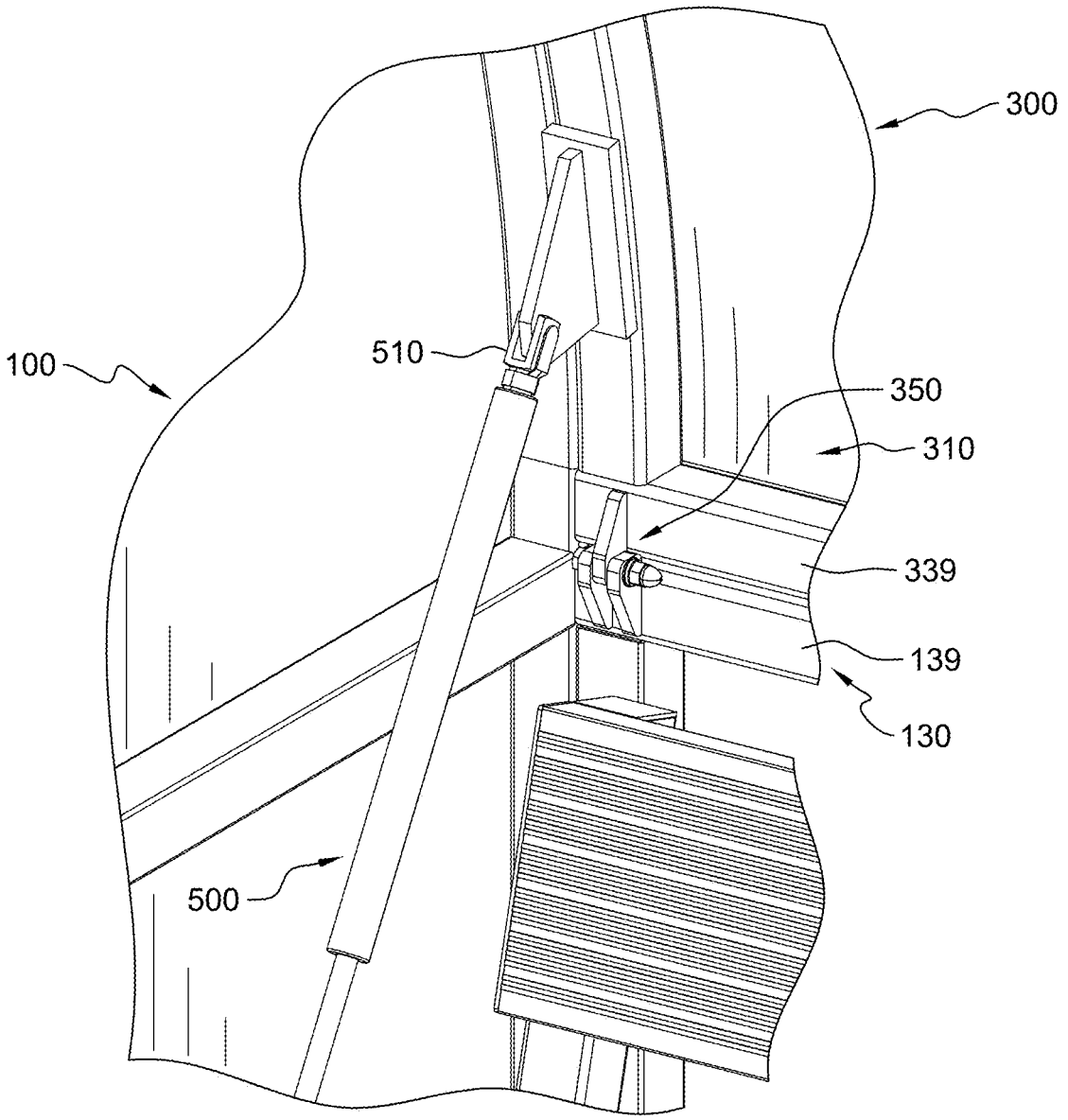
FIG. 6 is an enlarged perspective view of the inside of the left frame, the rear frame, and the lower portion of the canopy of the shelter of FIG. 1.

Elongated canopy 300 may be pivotally attached to frame structure 100 to allow for moving elongated canopy 300 from a raised position to lowered orientation. For example, lower elongated rear portion 310 (FIG. 2) of elongated canopy 300 may be pivotally attached to an upper portion of elongated rear frame 130 (FIG. 2). For example, as shown in FIG. 6, a hinge 350 may operably pivotally attach to cross member 139 of rear frame 130 to cross member 339 of elongated canopy 300. A plurality of hinges may be disposed between elongated canopy 300 and rear frame 130, e.g., a hinge may be disposed adjacent to the left frame, and a hinge may be disposed adjacent to the right frame. A pair of hinges may also be disposed in the middle portions of the shelter halves as shown in FIGS. 1 and 5.

Figure 7:
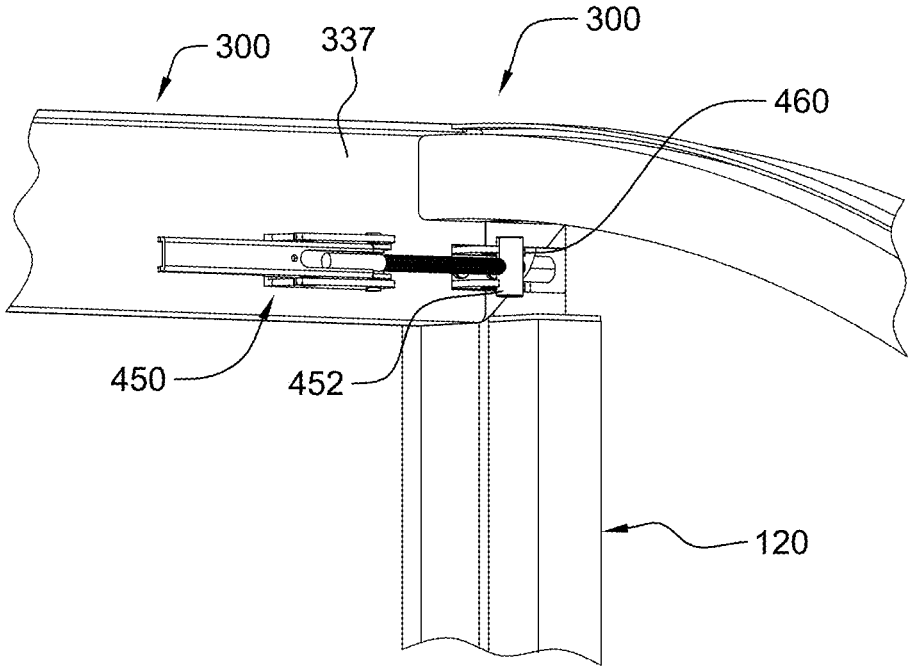
FIG. 7 is an enlarged perspective view of the inside of an upper portion of the left frame and an upper portion of the canopy of the shelter of FIG. 1.
Figure 8:
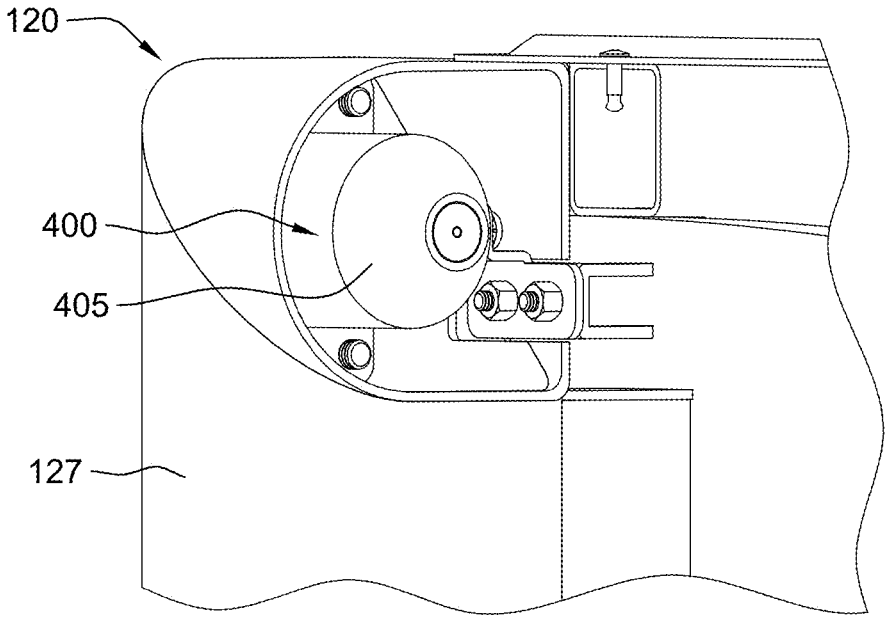
FIG. 8 is an enlarged perspective side view, partially cut away, of the upper portion of the left frame of FIG. 1.

With reference to FIG. 7, left frame 120 may be operably releasably coupled to the left side of elongated canopy 300 when elongated canopy 300 is positioned in the raised orientation. For example, left frame 120 may include a pin 400, shown in FIG. 8, which pin 400 is releasably engageable with a cavity or an aperture 410, shown in FIG. 10, disposed in a left end cap 336 of horizontal front post 337 of elongated canopy 300. Pin 400 (FIG. 8) may have a tapered shape such as a fustoconical shape 405. Aperture 410 (FIG. 10) may have a tapered shape or countersunk hole for receiving the tapered portion 405 (FIG. 8) of pin 400 (FIG. 8). Pin 400 (FIG. 8) may be locked in place with a toggle latch 450 attached to the inner surface of horizontal front post 337 of elongated canopy 300, shown in FIG. 7, for biasing pin 400 (FIG. 8) in a direction toward elongated canopy 300 into engagement in aperture 410 (FIG. 10) for releasably coupling left frame 120 to a left side portion of elongated canopy 300 when elongated canopy 300 is positioned in the raised orientation.

Figure 9:
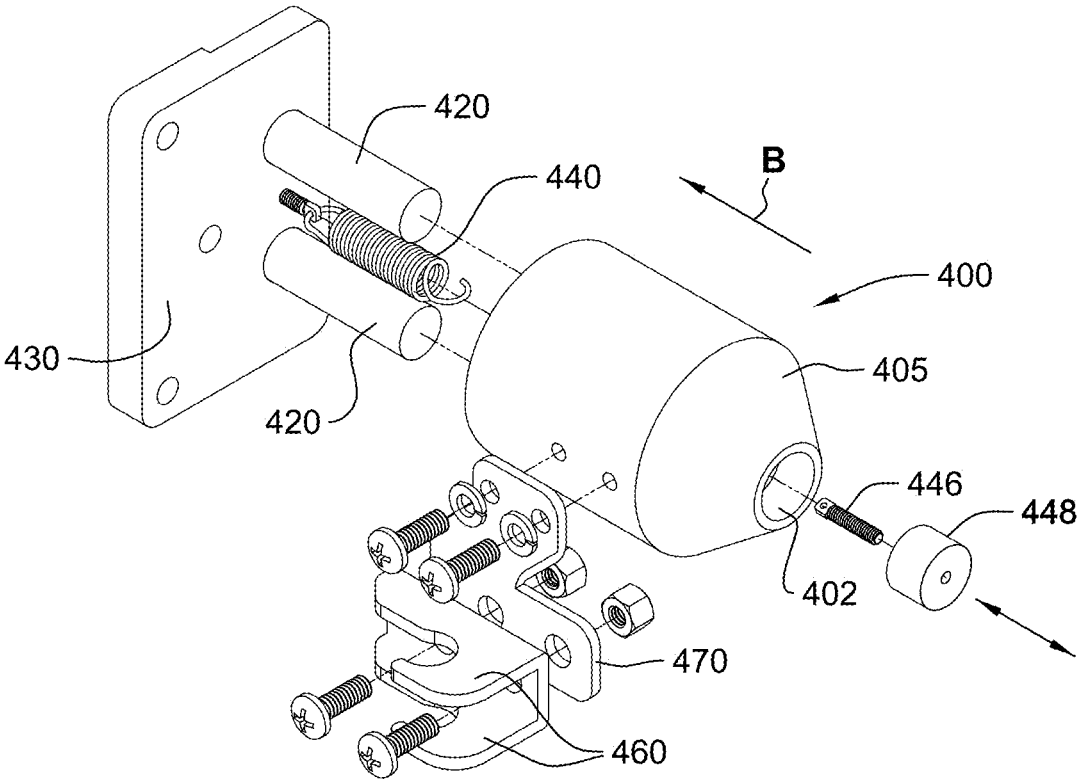
FIG. 9 is an exploded perspective view of the movable pin of FIG. 8.

As shown in FIG. 9, pin 400 may be operably slidably restrained on two post 420, which posts are attached to and extend from a back plate 430. Back plate 430 is operably attachable inside vertical front post 127 (FIG. 8) of left frame 120 (FIG. 8). A first spring 440 is attached at one end to back plate 430, extends through pin 400, and is attached at the other end to a rod 446. Rod 446 attaches to a plug 448, which plug is received in an aperture 402 in pin 400 so that spring 440 for normally biases pin 400 in a direction B toward back plate 430.

Figure 10:
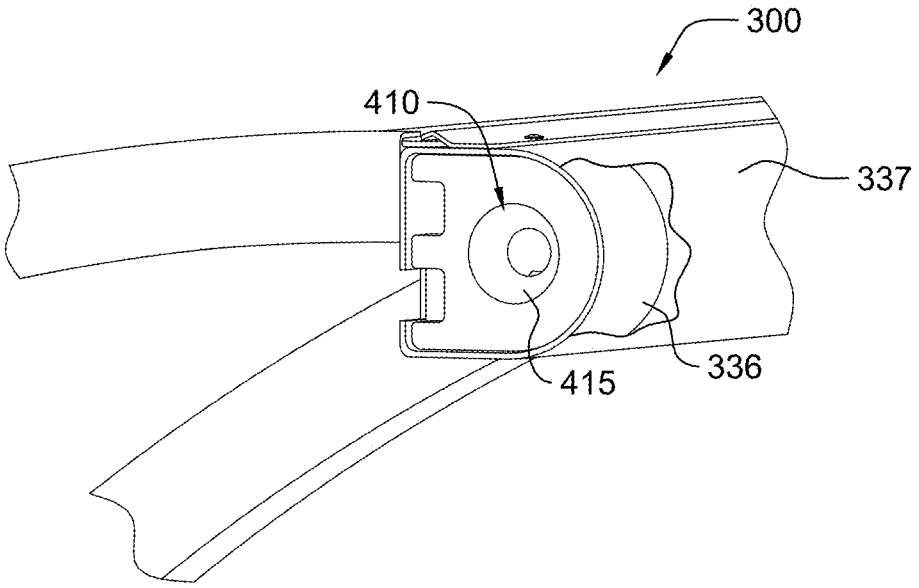
FIG. 10 is an enlarged perspective view of the upper left portion of the canopy of FIG. 1.

A pair of spaced-apart hook-shaped members or catch 460 is attached to a support 470, which support 470 is attached to the side of pin 400. Catch 460 is spaced and extends laterally outwardly from the side of pin 400. With reference again to FIG. 7, toggle latch 450 includes a barrel nut 452 operable for engaging catch 460 to draw or pull pin 400 (FIG. 8) into aperture 410 (FIG. 10) of elongated canopy 300 (FIG. 10). The right frame may be similarly operably releasably coupled to the right side elongated canopy 300 when elongated canopy 300 is positioned in the raised orientation.

Figure 11:
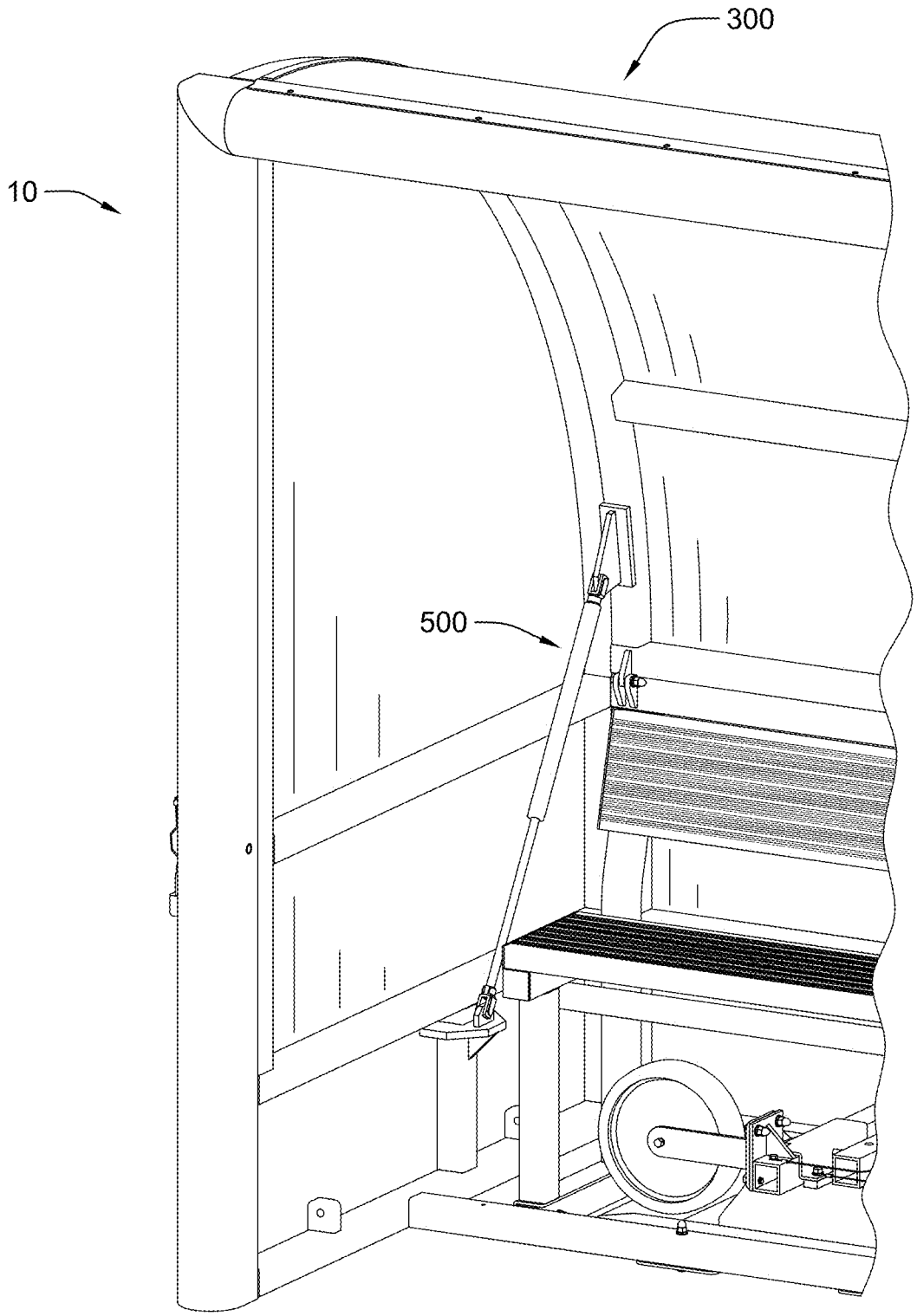
FIG. 11 is an enlarged perspective view of the inside of the left frame, the rear frame, and the canopy of the shelter of FIG. 1.
Figure 12:
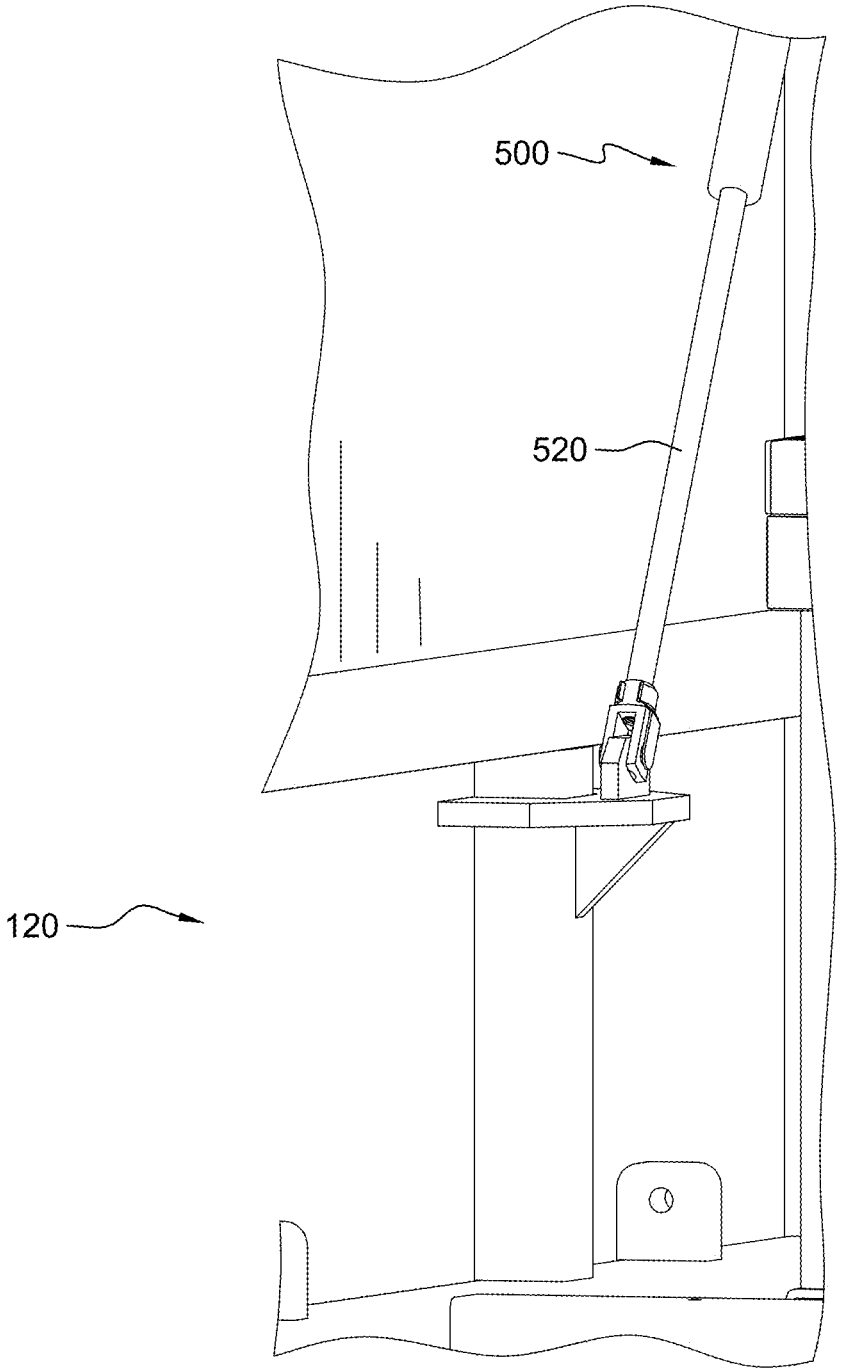
FIG. 12 is an enlarged perspective view of the inside of the left frame of FIG. 11.

With reference to FIG. 11, shelter 10 may include a left biasing member 500 such as a gas shock or hydraulic assist for inhibiting the lowering of elongated canopy 300 from the raised orientation to the lowered orientation and/or for aiding the raising of elongated canopy 300 from the lowered orientation to the raised orientation. As shown in FIG. 6, an upper end 510 of biasing member 500 may be operably attached to a left end portion of elongated canopy 300. As shown in FIG. 12, a lower end 520 of biasing member 500 may be operably attached to left frame 120. A right biasing member may be similarly disposed on the right side of the shelter. For example, the gas shocks or hydraulic assists may be operable so that an operator applying about a 20 pound force to front bar or horizontal front post 337 is operable to raise the canopy to a raised orientation and so that the operator applying about a 20 pound force to front bar or horizontal front post 337 is operable to lower the canopy to a lowered orientation.

Figure 13:
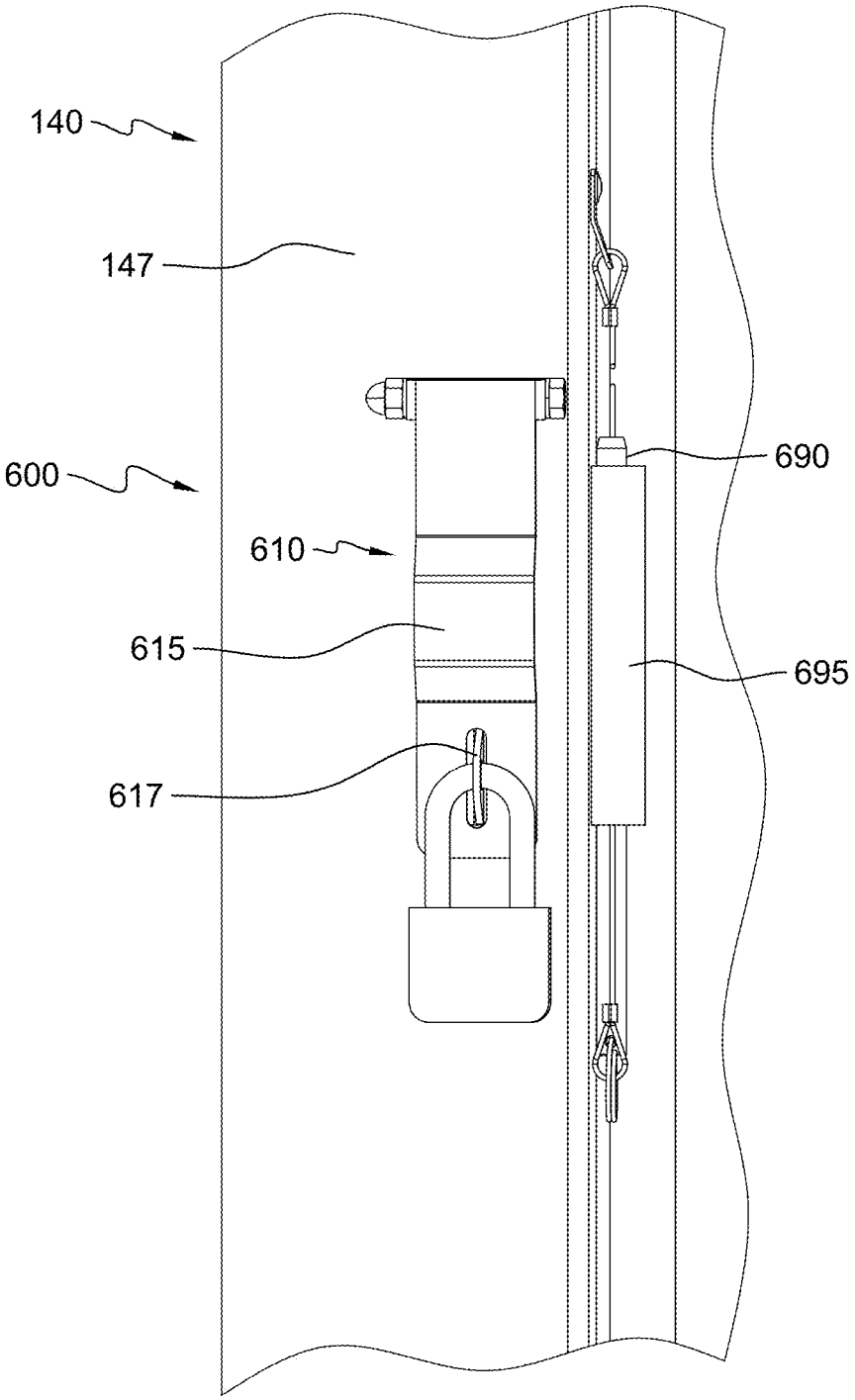
FIG. 13 is an enlarged perspective view of detail 13 of FIG. 1.
Figure 14:
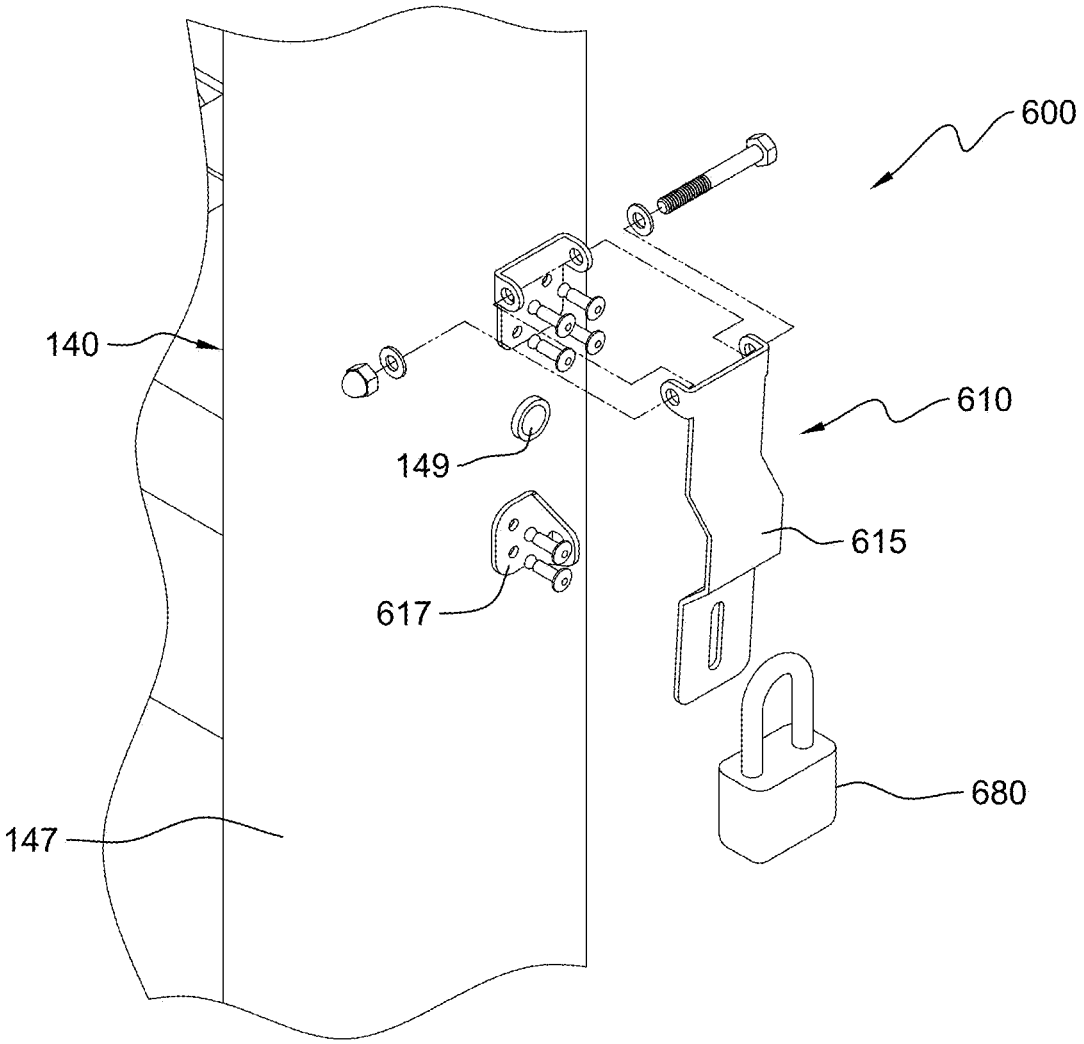
FIG. 14 is an enlarged, exploded perspective view of FIG. 13.

FIGS. 13 and 14 illustrate a locking device 600 for locking elongated cover 300 (FIG. 1) to right frame 140 when the elongated canopy is positioned in the lowered orientation. For example, locking device 600 may include the combination of a hasp 610 and a pin 690. (FIG. 13 shown in a retracted stored position) Hasp 610 includes a hinged metal strap 615 that fits over a staple 617. Strap 615 is positioned over an aperture 149 (FIG. 14) that extends from the outside of vertical front post 147 of right frame 140 to the inside of front portion 147 of right frame 140, and which aperture 149 (FIG. 14) is alignable with an aperture (not shown) extending through the side of right most curved member 338 (FIG. 3). A pin 690 (FIG. 13) may be positioned in a cylinder 695 when not in use, and removed and inserted in aperture 149 (FIG. 14) and the aperture (not shown) extending through the side of right most curved member 338 (FIG. 3). After inserting and installing pin 690 (FIG. 13) in the aligned apertures when the elongated canopy is positioned in the lowered orientation, hinged metal strap 615 is moved to its lowered position. A padlock 680 attached through an opening in staple 617 is operable to secure strap 615 in place, which prevents the removal of pin 690 so that the elongated canopy is retained in its lowered orientation. A second locking devices may be similarly employed for locking elongated cover 300 (FIG. 3) to the left frame when the elongated canopy is positioned in the lowered orientation. It will be appreciated that other locking devices and mechanisms may be suitably employed to maintain the elongated cover in a lowered orientation.

Figure 15:
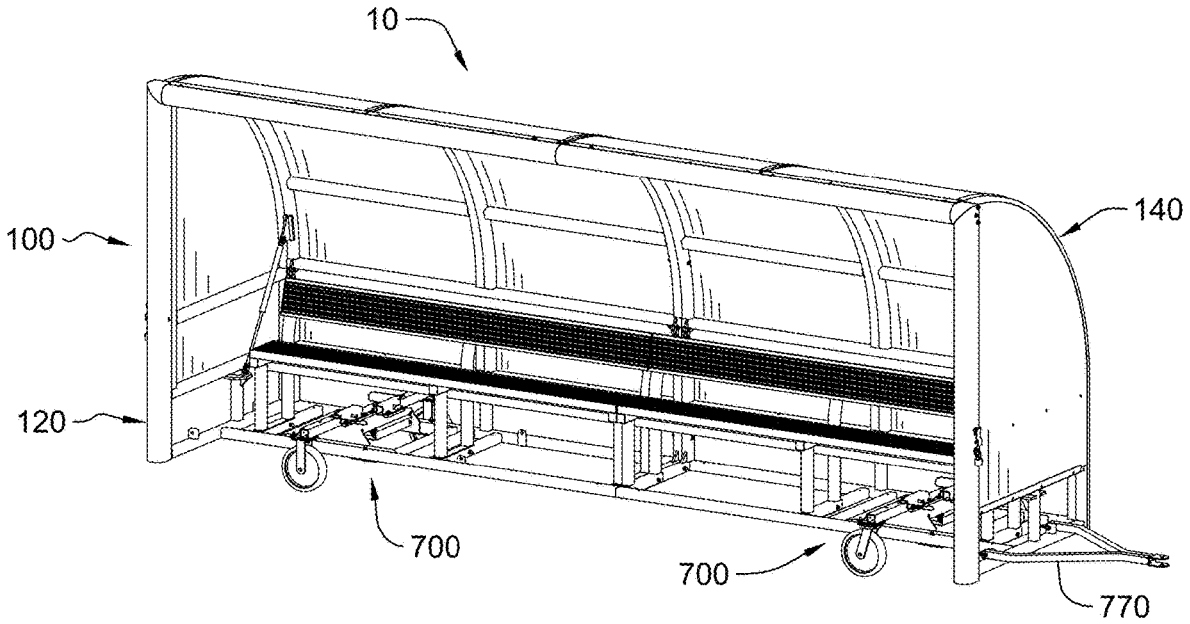
FIG. 15 in a front perspective view of the shelter of FIG. 1 with the mobility devices disposed in a lowered orientation.
Figure 16:
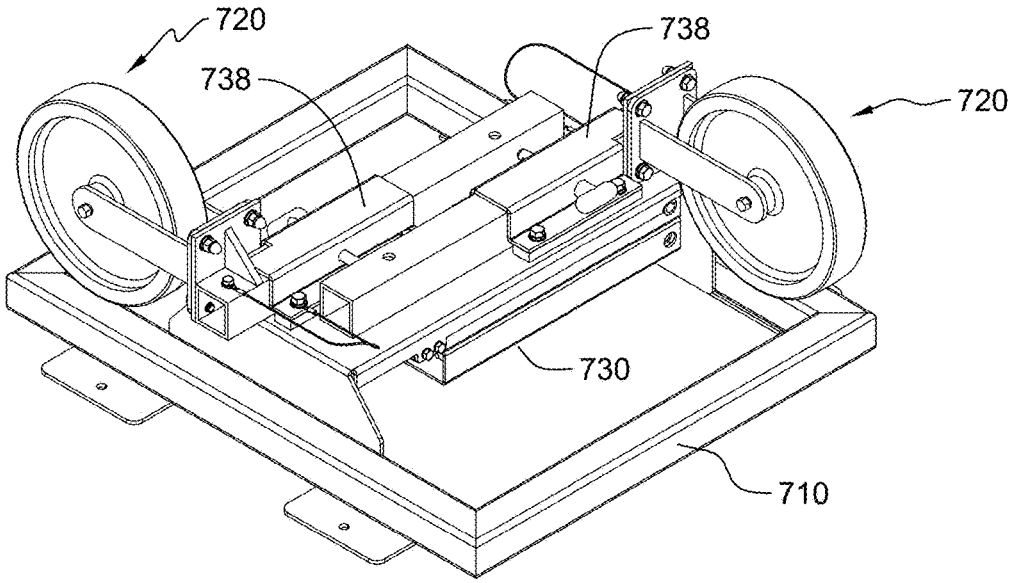
FIG. 16 in an enlarged perspective view of one of the mobility devices of FIG. 15.

FIG. 15 illustrates shelter 10 disposed in a transportable configuration for moving shelter 10 from one location to another different location. For example, shelter 10 may include a left mobility device 700 attachable to frame structure 100 adjacent to left frame 120, and a right mobility device 700 attachable to frame structure 100 adjacent to right frame 140. FIG. 16 illustrates mobility device 700 having a frame 710, scissor jack 730, and a pair of wheel axle assemblies 720.

Figure 17:
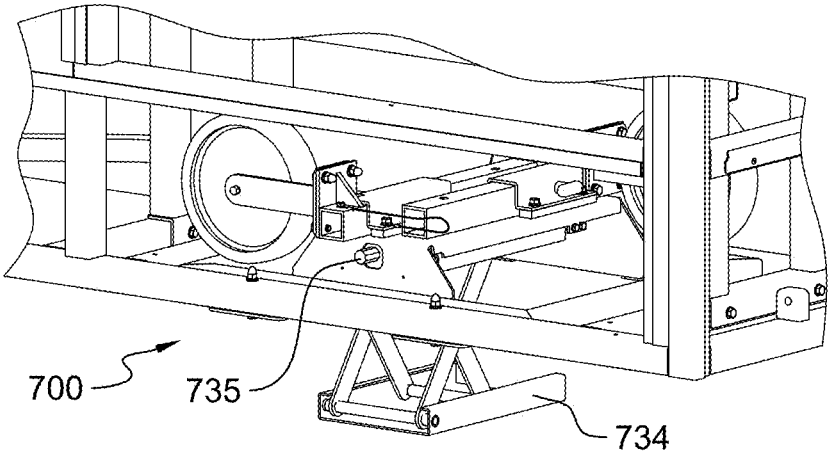
FIGS. 17-19 are enlarged partial perspective views of right mobility device of FIG. 15 illustrating the transition from a stored configuration to a transportable position.
Figure 18:
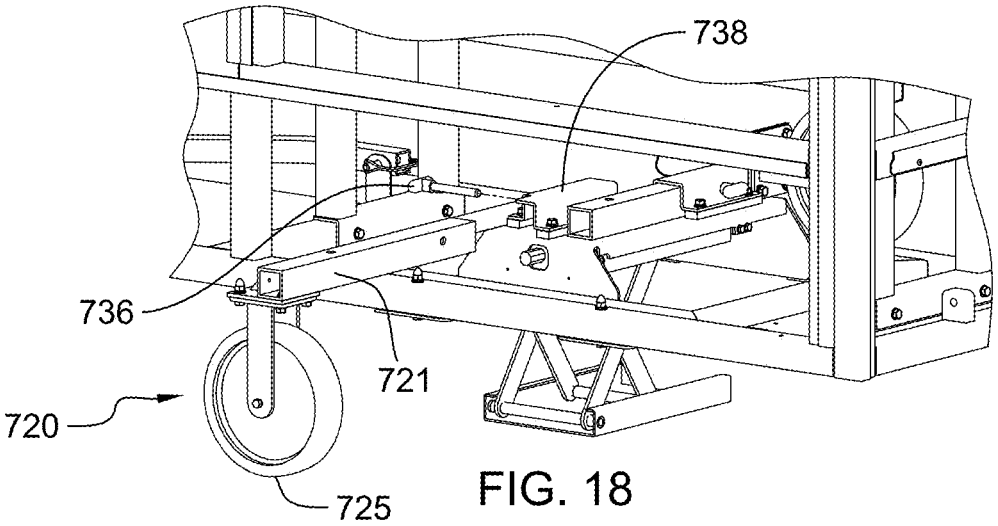
Figure 19:
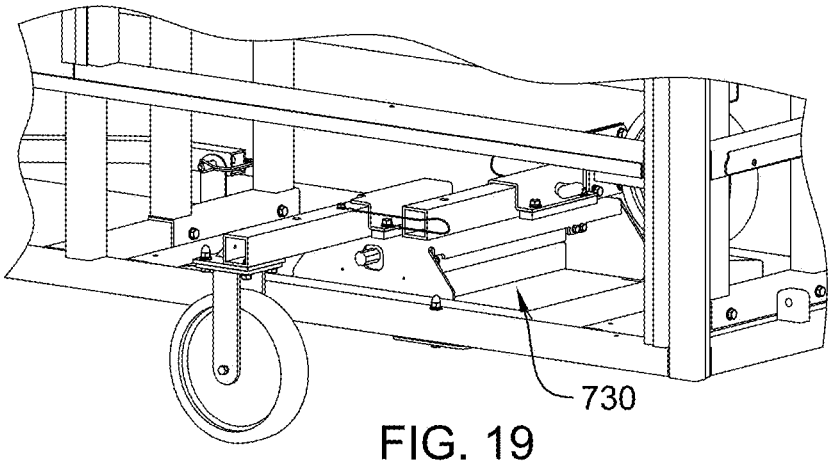

FIGS. 17-19 generally illustrate the transition of the shelter and mobility device 700 from a stored position to a raised shelter transportable position.

Initially, as shown in FIG. 1, shelter 10 may be disposed on level ground with canopy 300 disposed in a locked raised orientation and with mobility devices 700 disposed in a stored configuration. As show in FIG. 17, one of the mobility devices 700 may be operated. For example, scissor jack 730 of a right mobility device 700 is operated to force a lower base plate 734 downwardly, which results in the bottom right side of the shelter being raised off the ground approximately 6 inches. An impact drill or a ratchet (not shown) with a ⅞ inch socket may be used to rotate a screw 735 of scissor jack 730 to force base plate 734 downwardly, which in turn raises the right side of the shelter off the ground.

With reference to FIG. 18, pull pins 736 are removed. Once removed, each wheel axle assembly 720 having a post 721 is able to be slid outwardly from a bracket 738 and rotated 90 degrees so the wheels 725 face the ground. Wheel axle assembly 720 is then slid back into bracket 738 in the new orientation, leaving it extended past the shelter framework so that a furthermost hole in post 721 aligns with a hole in support bracket 738. As best shown in FIG. 16, bracket 738 may be a hat channel.

As shown in FIG. 19, using the impact drill or ratchet, scissor jack 730 is raised until the weight of the shelter is disposed on the wheels. The impact drill or ratchet is used to continue to retract the scissor jack until it is completely above the bottom of the shelter. The above steps are repeated for the left mobility device. One of the mobility devices may have fixed wheels, e.g., wheels that do not swivel, and the other of the mobility devices may have swivel wheels. The tow hitch 770 (FIG. 1) is removed from its storage position, e.g., suitable pins are removed, and the tow hitch is attached using the pins to mounting blocks on the end frames of the shelter adjacent to the mobility device having the swivel wheels as shown in FIG. 15. The above steps can be reversed to lower the shelter and store mobility devices. The mobility devise may include scissor jacks with a 1,100 pound capacity. For example, a suitable scissor may be Extreme Max 5001.5044 Wide Motorcycle Scissor Jack having a 1,100 pound lifting capacity. The wheels may be 10 inch foam filled wheels.

With reference again to FIG. 1, a removable towing bar 770 may be stored along the bottom of frame structure 100 when not in use. Towing bar 770 is removable form the stored position and releasably attachable to right frame 140 for use in moving shelter 10 from one location to another location as shown in FIG. 15. Towing bar 770 may also be releasably attachable to left frame 120 for use in moving shelter 10 from one location to another location.

With reference again to FIG. 1, elongated canopy 300 is positioned in a raised orientation with lower elongated portion 310 (FIG. 2) of elongated canopy 300 extending from frame structure 100, a middle elongated portion 330 (FIG. 2) of elongated canopy 300 disposed over elongated bench 200, and an upper elongated portion 340 of elongated canopy 300 extending above and in front of elongated bench 200 so that upper elongated portion 340 of elongated canopy 300, vertical front post 127 of left frame 120, and vertical front post 147 of right frame 140 define front facing opening 12 along a vertical plane allowing access by users to elongated bench 200. As shown in FIG. 3, elongated canopy 300 is positionable in a lowered orientation with lower elongated portion 310 of elongated canopy 300 extending from elongated rear frame 130 (FIG. 4), and upper elongated portion 340 of elongated canopy 300 extending below a front portion of elongated bench 200, extending in front of vertical front posts 127 and 147, and extending adjacent to the ground so that access by users to elongate bench 200 is inhibited.

Figure 20:
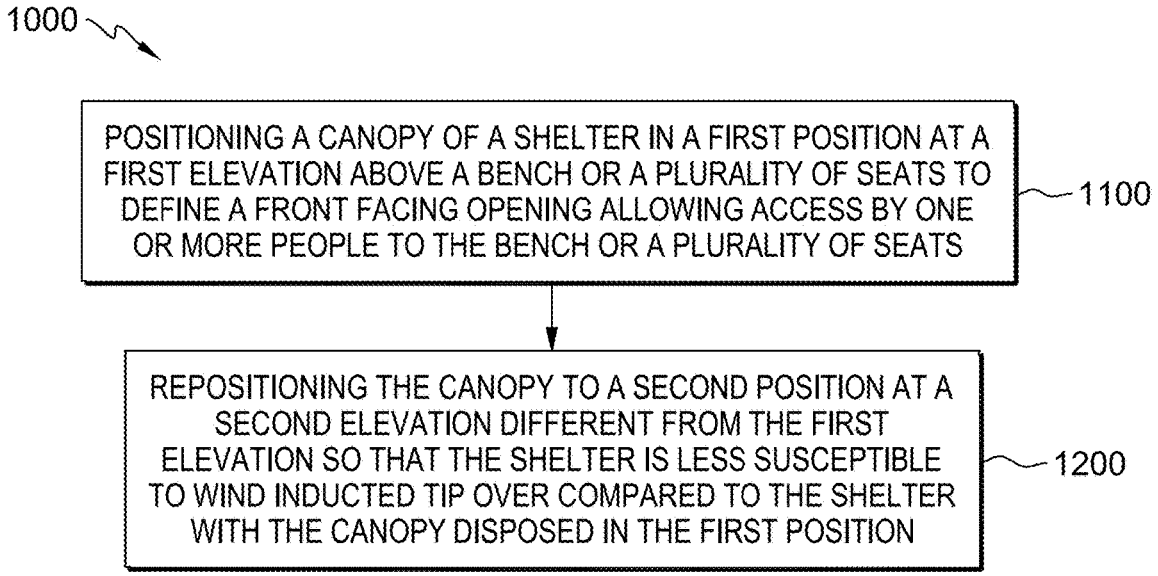
FIG. 20 is a flowchart of a method according to an embodiment of the present disclosure.

FIG. 20 is illustrates a method 1000 according to an embodiment of the present disclosure. In this illustrated embodiment, method 1000 includes at 1100 positioning a canopy of a shelter in a first position above a bench or a plurality of seats to define a front facing opening allowing access by one or more people to the bench or a plurality of seats, and at 1200 repositioning the canopy to a second position so that the shelter in the second position is less susceptible to wind induced tip over compared to the shelter disposed in the first position.

Figure 21:
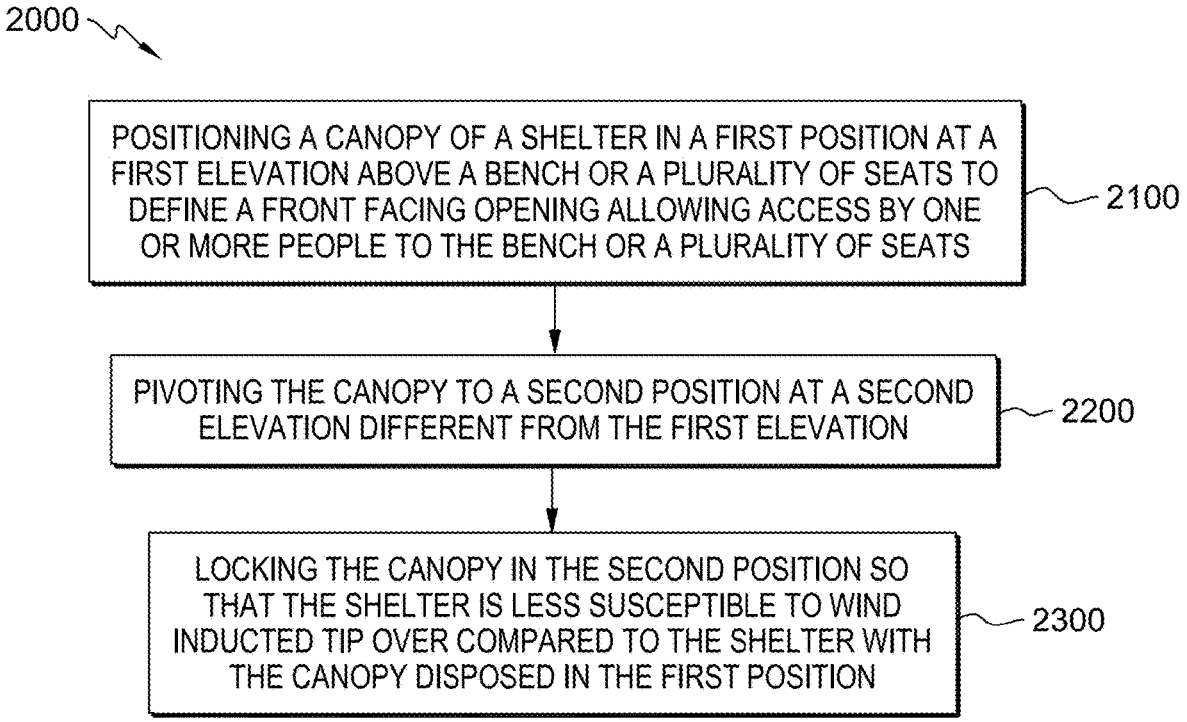
FIG. 21 is a flowchart of a method according to an embodiment of the present disclosure.
Figure 22:
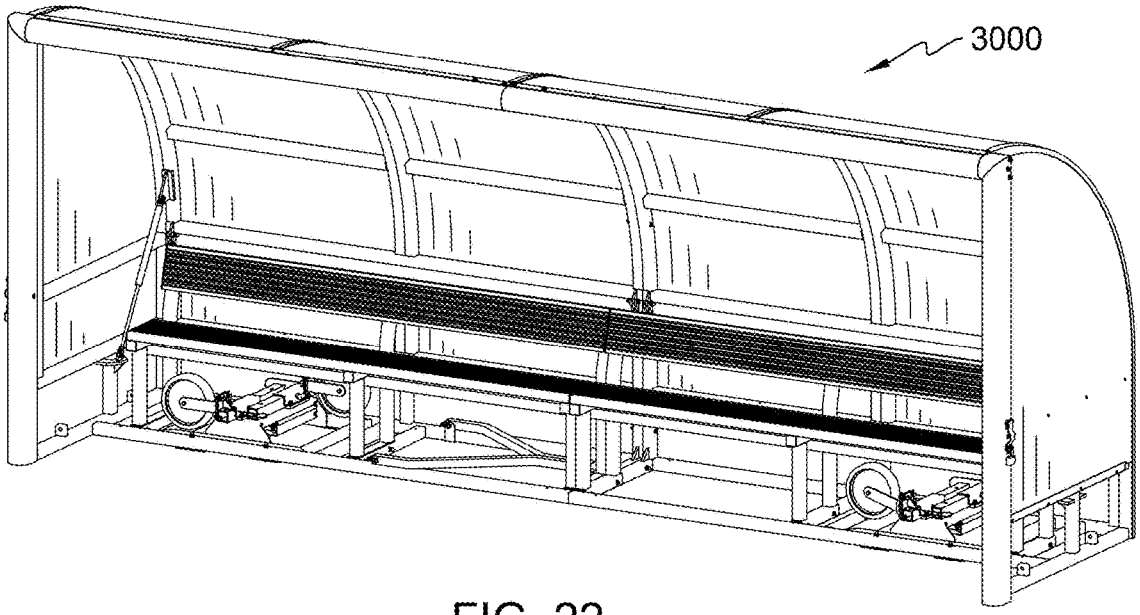
FIGS. 22-27 are a perspective, a front elevational, a left side elevational, a right side elevational, a rear, and a top views of a shelter according to an embodiment of the present disclosure in which the canopy of the shelter is disposed in a raised orientation.
Figure 23:
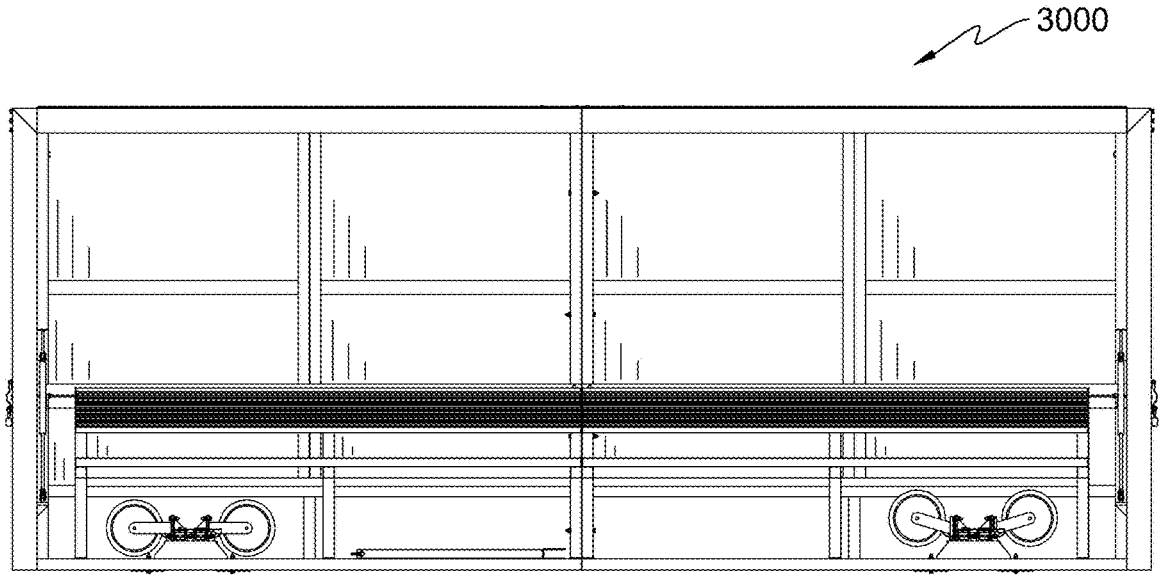
Figure 24:
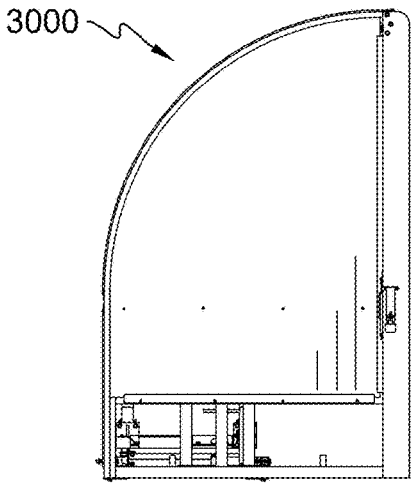
Figure 25:
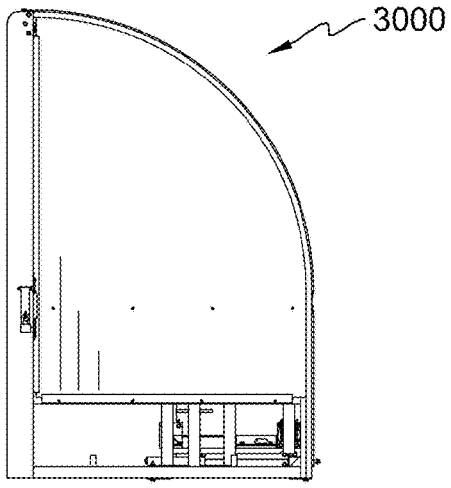
Figure 26:
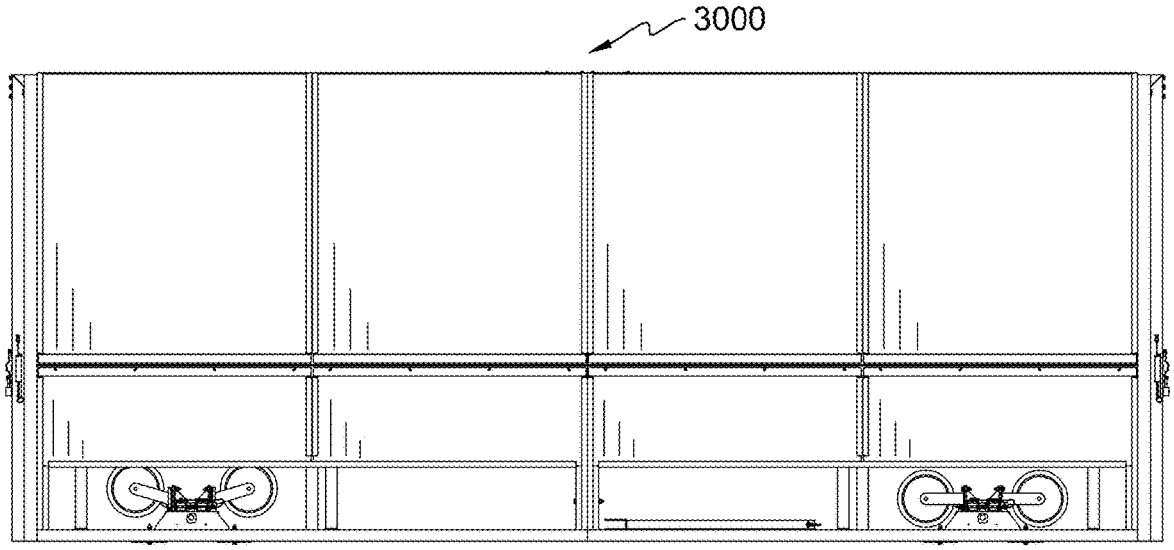
Figure 27:
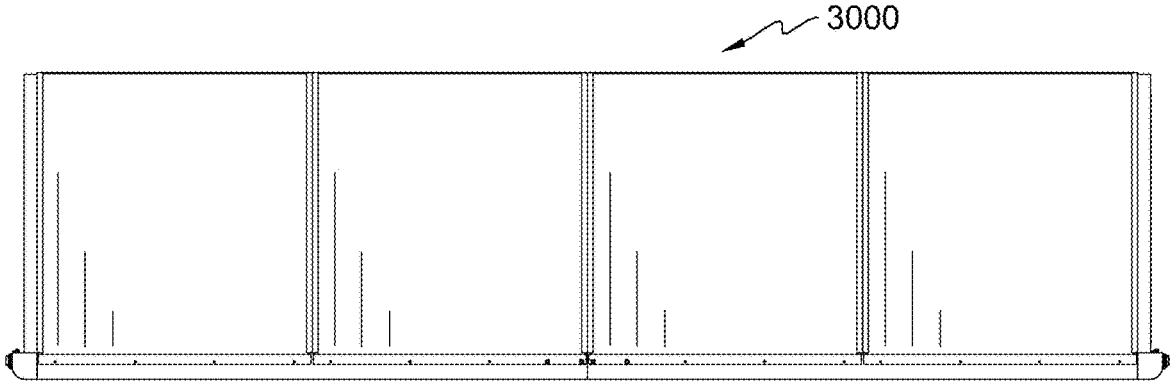
Figure 28:
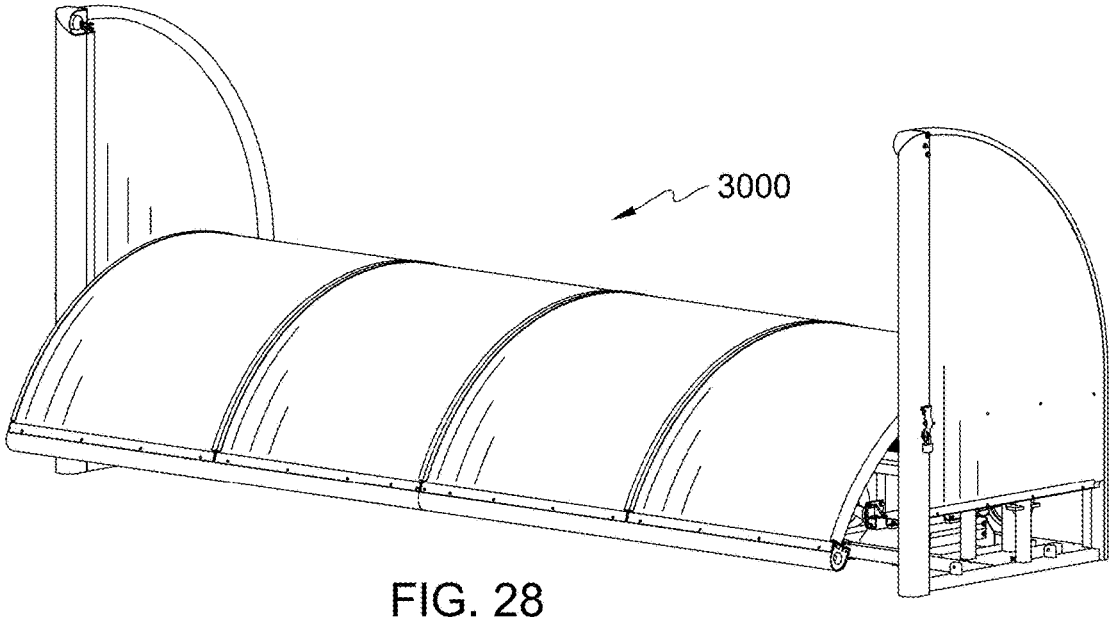
FIGS. 28-33 are a perspective, a front elevational, a left side elevational, a right side elevational, a rear, and a top views of a shelter according to an embodiment of the present disclosure in which the canopy of the shelter is disposed in a lowered orientation.
Figure 29:
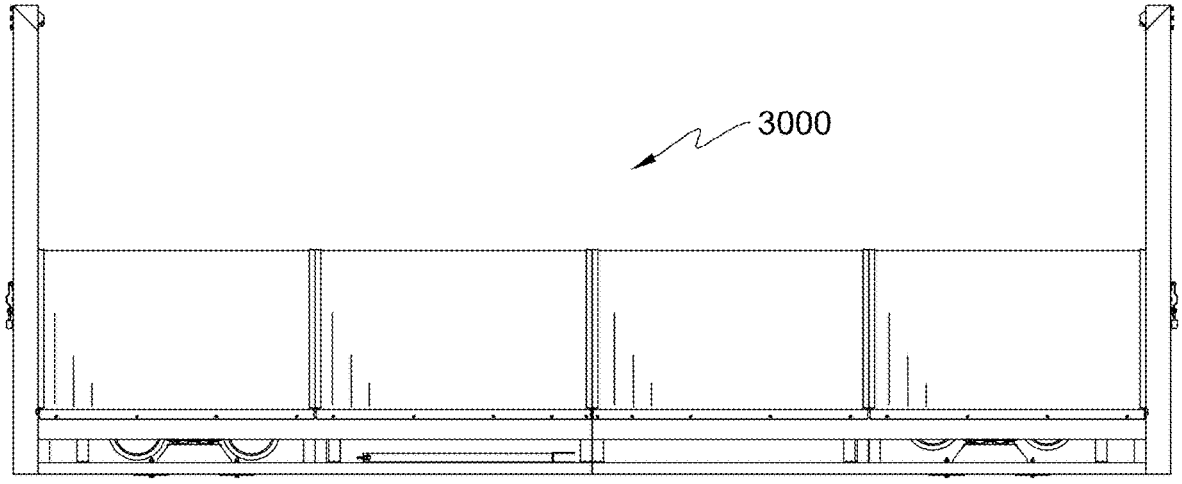
Figure 30:
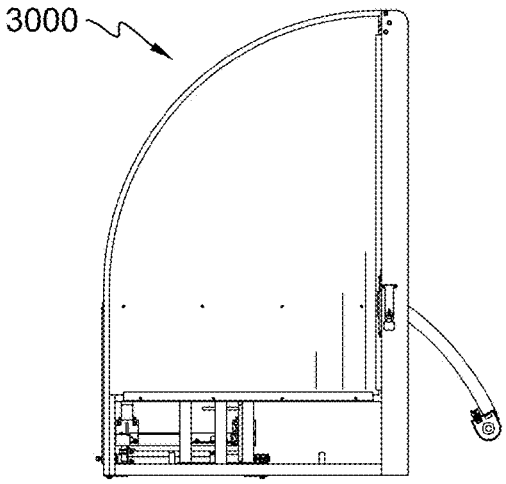
Figure 31:
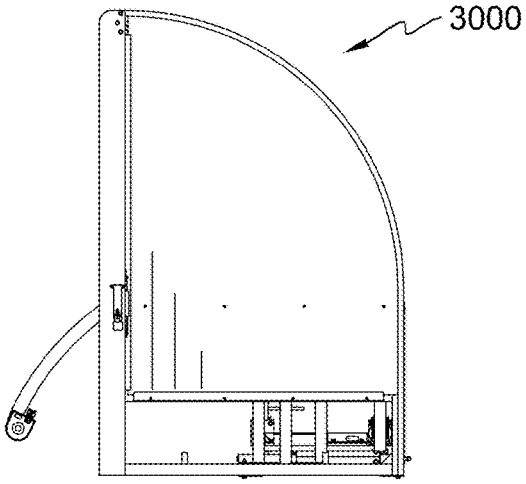
Figure 32:
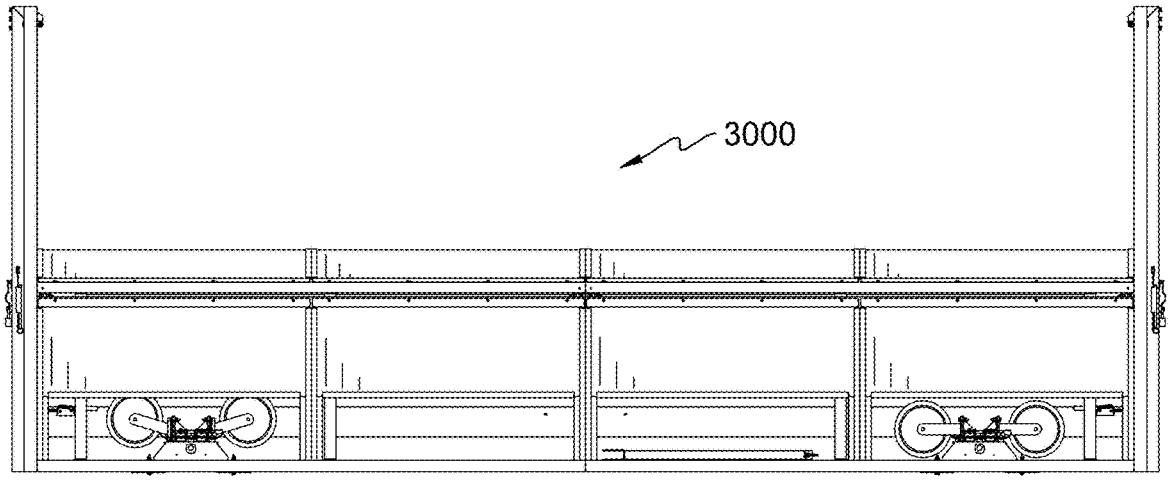
Figure 33:
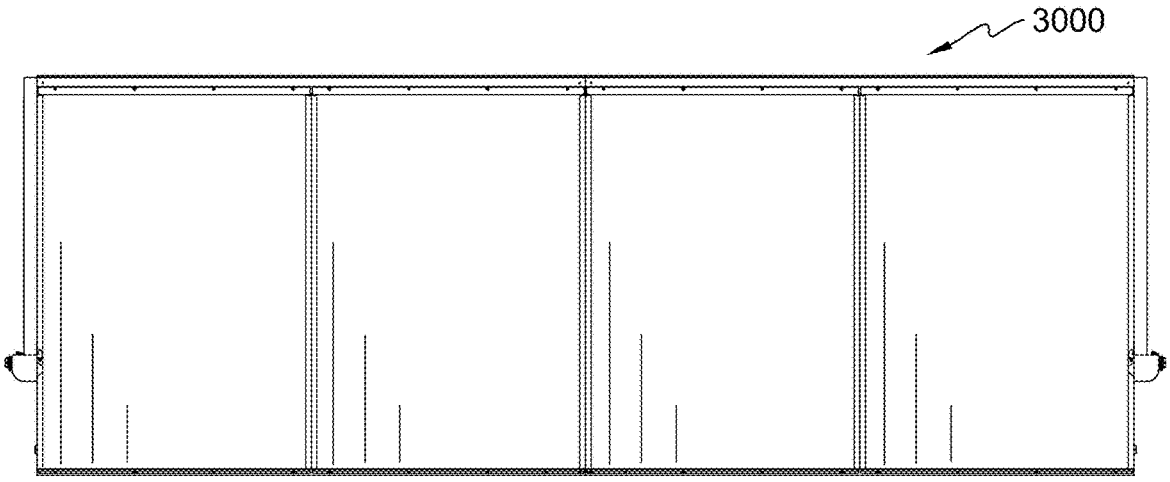

FIG. 21 is illustrates a method 2000 according to an embodiment of the present disclosure. In this illustrated embodiment, method 2000 includes at 2100 positioning a canopy of a shelter in a first position above a bench or a plurality of seats to define a front facing opening allowing access by one or more people to the bench or the plurality of seats, at 2200 pivoting the canopy to a second position, and at 2300 locking the canopy in the second position so that the shelter in the second position is less susceptible to wind inducted tip over compared to the shelter disposed in the first position.

With reference again to FIGS. 1 and 2, shelter 10 may include one of more retainers 900 according to an embodiment of the present disclosure. For example, retainer 900 may be disposed in the adjacent to where the shelter is to be positioned on the field. Retainer 900 may provide an additional anchoring mechanism for securing the shelter in position such as to inhibit the shelter from toppling and tipping over due to athletes or players hanging on the front bar of the canopy or climbing on the shelter when the canopy is disposed in a raised orientation. Retainer 900 may include an enclosure 902, which may be mounted in the ground on concrete. Retainer 900 may include a clamping member 905 operably connected to enclosure 902, and which clamping member is movably positionable over a bottom-cross member 131 (FIG. 1) or a bottom cross-member 136 (FIG. 4). Examples of suitable retainers are disclosed in U.S. Pat. Nos. 8,777,784; 8,172,705; 7,527,569; and 7,331,880 issued to Roger and entitled "Soccer Goal Retainer", the entire contents of which is incorporated herein by reference.

With reference still to FIG. 1, shelter 100 may have an overall length L1 of about 5 feet to about 33 feet, and preferably about 9 feet, about 17 feet, and about 25 feet, a height H1 of about 7 feet to about 9 feet, and a depth D1 of the left and right frames of about 4 feet to about 5 feet. Forward facing opening may have a length L2 of about 4 feet to about 32 feet, and preferably about 8 feet, about 16 feet, and about 24 feet. Forward facing opening may have a height H of about 6 feet to about 8 feet, and preferably about 6.5 feet. The upper portion of the left and right frames have be curved having a radius R of about 3 feet to about 5 feet, and preferably 4 feet. The bench may be about 4 feet to about 32 feet, and preferably about 7 feet, about 15 feet, and about 24 feet.

As shown in FIG. 3, elongated canopy 300 may have a length L3 of about 4 feet to about 32 feet, and preferably about 8 feet, about 16 feet, and about 24 feet. Elongated canopy 300 may have a width W of about 7 feet and 9 feet, preferably about 6 feet. Canopy 300 may have a curved cross-section across the width, which curved cross-section has a constant radius of about 3 feet to about 5 feet, and preferably 4 feet. From the present description, it will be appreciated that the elongated canopy may have other suitable cross-sectional shapes such as planar, V-shaped, multiple planar shaped, two or more different curved portions, and combinations thereof. The right frame and left frame may or may not have outer edges that correspond to the cross-sectional shape of the canopy.

With reference again to FIG. 5, illustrated shelter 10 may be a 16 foot long shelter, which includes two 8 foot halves. An additional 8 foot center section (not shown) may be provided to form a 24 foot long shelter. It will be appreciated that any suitable length, height and depth shelter may be employed. For a 16 foot long shelter, suitable biasing members 500 (only one of which is shown in FIG. 5) may include gas shocks or gas springs having a capacity of 400 pounds. A suitable gas shock or gas spring includes Model No. 9416K52 available from McMaster-Carr. A 24 foot long shelter may utilize 550 pound gas springs. An 8 foot long shelter may utilize 200 pound to 300 pound gas springs.

FIGS. 21-26 are a perspective, a front elevational, a left side elevational, a right side elevational, a rear, and a top views of a shelter 3000 according to an embodiment of the present disclosure in which the canopy of the shelter is disposed in a raised orientation.

FIGS. 27-32 are a perspective, a front elevational, a left side elevational, a right side elevational, a rear, and a top views of shelter 3000 in which the canopy of the shelter is disposed in a lowered orientation.

Figure 34:
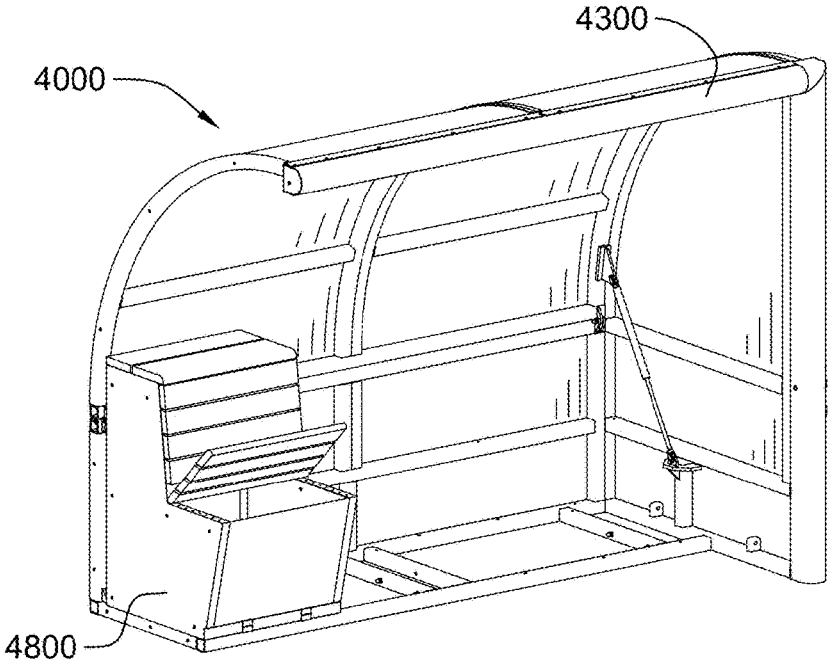
FIG. 34 is a partial perspective view of a shelter having a repositionable canopy and a storage compartment according to an embodiment of the present disclosure with a canopy positioned in a raised orientation.

In some embodiments, a storage compartment or integral storage compartment may be provided in the shelter. For example, a bottom, and front, left, right, and rear sidewalls may be provided below the bench seat to provide a storage area under the seat. The storage area may be operable for containing sports equipment when the shelter is not in use. The storage compartment may include a pivotable bench or front side wall, and may be releasably lockable, allowing access to the storage area. In some embodiments, multiple rows of integral seating, e.g., benches or rows of seating, may be provided. For example, FIG. 34 illustrates a shelter 4000 having a repositionable canopy 4300 and a combination bench and storage compartment 4800 according to an embodiment of the present disclosure.

Figure 35:
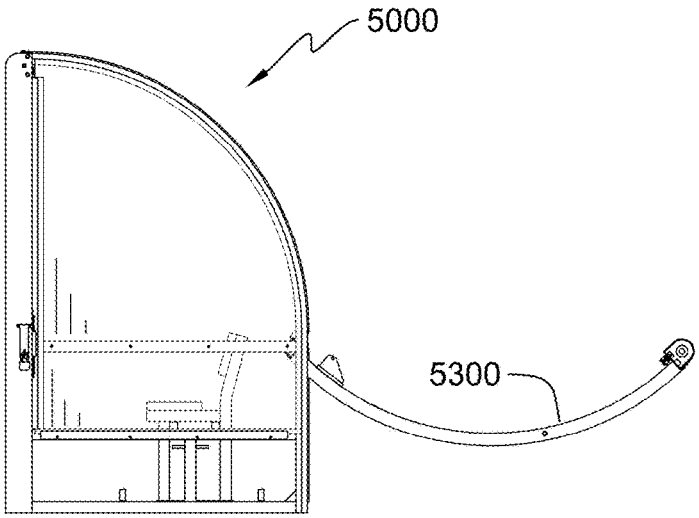
FIG. 35 is a side elevational view of a shelter having a repositionable canopy according to an embodiment of the present disclosure with the canopy positioned in a lowered orientation.

FIG. 35 illustrates a shelter 5000 having a repositionable canopy 5300 according to an embodiment of the present disclosure. As shown in FIG. 35, canopy 5300 is positioned in a lowered orientation by being pivoted toward the rear of shelter 5000. The lowered orientation of shelter 5000 results in shelter 5000 being less susceptible to wind induced tip over compared to shelter 5000 with canopy 5300 disposed in a raised orientation.

Figure 36:
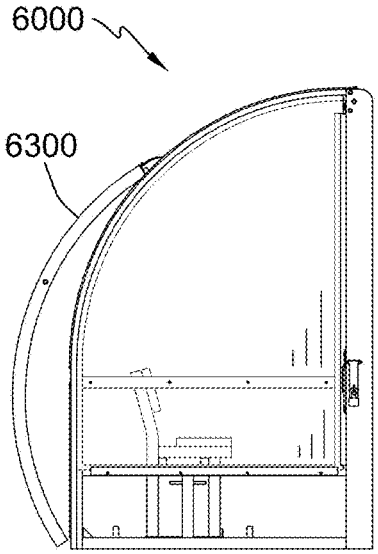
FIG. 36 is a side elevational view of a shelter having a repositionable canopy according to an embodiment of the present disclosure with the canopy positioned in a lowered orientation.

FIG. 36 illustrates a shelter 6000 having a repositionable canopy 6300 according to an embodiment of the present disclosure. As shown in FIG. 36, canopy 6300 is positioned in a lowered orientation by canopy 6000 being operably slid, for example a tracks, behind a bottom rear portion of shelter 6000. The lowered orientation of shelter 6000 results in shelter 6000 being less susceptible to wind induced tip over compared to shelter 6000 with canopy 6300 disposed in a raised orientation.

From the present disclosure, it will be appreciated that the shelters of the present disclosure having a movable canopy reduce the likelihood of the shelter tipping over during increased wind conditions compared to conventional shelters that are fully enclosed on three sides thereby trapping the wind load and creating a sail-like effect. For example, shelters of the present disclosure having a movable canopy and a rigid frame and polycarbonate-like enclosure panels and/or fabric covering reduce the likelihood of costly damage and repair due to wind-related tip-overs.

From the present disclosure, it will also be appreciated that the shelters of the present disclosure having openings around the lower portions of the shelter allows for increased air circulation particularly in direct sun light on a calm day compared to conventional shelters that are fully enclosed on three sides that tend to trap the air in the shelter. In other embodiments, shelters may be covered completely on the left, right, and rear sides of the shelters.

It will be further appreciated that the shelter of the present disclosure may be used for purposes other than team shelters. For example, the shelters may provide temporary pick-up locations for transportation services or other services, or sheltered seating use in protecting one or more people for temporary events such as road races, cycling, obstacle course races, golf tournaments, etc.

It is to be understood that the above description is intended to be illustrative, and not restrictive. For example, the above-described embodiments and/or features thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that features of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A shelter comprising:

a frame structure comprising a left frame and a spaced-apart right frame, said left frame having a vertical front post and an outer peripheral edge extending downwardly from an upper portion of said vertical front post to a rear portion of said frame structure, and said right frame having a vertical front post and an outer peripheral edge extending downwardly from an upper portion of said vertical front post to a rear portion of said frame structure;

a canopy extending between said left frame and said right frame, and comprising a front portion, a rear portion, a left edge portion extending from said front portion to said rear portion, and a right edge portion extending from said front portion to said rear portion;

said canopy positionable in a first position with said front portion of said canopy disposed at a first elevation between a front portion of said left frame and a front portion of said right frame so that said front portion of said canopy, said front portion of said left frame, and said front portion of said right frame define a front facing opening allowing access by one or more people into said shelter and under said canopy, and so that said left edge portion of said canopy is aligned with and in side-by-side relation to said outer peripheral edge portion of said left frame from said front post to said rear portion of said left frame, and said right edge portion of said canopy is aligned with and in side-by-side relation to said outer peripheral edge portion of said right frame from said front post to said rear portion of said left frame; and said canopy positionable in a second position with said front portion of said canopy disposed at a second lower elevation relative to said left frame and said right frame so that said canopy disposed in said second position results in said shelter being less susceptible to wind induced tip over compared to said shelter with said canopy disposed in said first position.

2. The shelter of claim 1 wherein said canopy is positionable in said second position with said rear portion of said canopy disposed between a rear portion of said left frame and a rear portion of said right frame.

3. The shelter of claim 1 wherein said canopy is positionable in said second position so that access by the one or more people into said shelter is inhibited.

4. The shelter of claim 1 wherein said canopy is positionable in said second position with said front portion of said canopy extending forward of said lower front portion of said left frame and said lower front portion of said right frame.

5. The shelter of claim 1 wherein said canopy is positionable in said second position with said front portion of said canopy extending adjacent to the ground.

6. The shelter of claim 1 wherein said canopy, an upper portion of said left frame, and an upper portion of said right frame are covered, and a lower portion of said left frame, a lower portion of said right frame, and a lower portion of a rear of the frame structure are uncovered.

7. The shelter of claim 1 wherein said left frame comprises at least one rigid solid panel, said right frame comprises at least one rigid solid panel, and said canopy comprises a plurality of spaced-apart frame members and at least one rigid solid panel.

8. The shelter of claim 1 wherein said rear portion of said canopy is movably connected to said frame structure in said first position and in said second position.

9. The shelter of claim 1 wherein said rear portion of said canopy is pivotally attached to said frame structure in said first position and in said second position.

10. The shelter of claim 1 wherein said canopy comprises a curved cross-section across a width of said canopy.

11. The shelter of claim 1 further comprising a bench operably attachable to said frame structure.

12. The shelter of claim 1 wherein said shelter comprises a storage compart.

13. A method comprising:

providing the shelter of claim 1 with the canopy positioned in the first position; and moving the canopy to the second position.

14. The method of claim 13 further comprising:

locking said canopy in said second position.

15. A team shelter comprising:

a frame structure comprising a left frame, a right frame, and an elongated rear frame extendable between said left frame and said right frame, said left frame having a vertical front post and an outer peripheral edge extending downwardly from an upper portion of said vertical front post to a rear portion of said frame structure, and said right frame having a vertical front post and an outer peripheral edge extending downwardly from an upper portion of said vertical front post to a rear portion of said frame structure;

an elongated bench attachable between said left frame and said right frame;

an elongated canopy extending between said left frame and said right frame, and comprising a front portion, a rear portion, a left edge portion extending from said front portion to said rear portion, and a right edge portion extending from said front portion to said rear portion;

said elongated canopy positionable in a raised orientation with a lower elongated portion of said elongated canopy extending from an upper portion of said elongated rear frame of said frame structure, a middle elongated portion of said elongated canopy disposed over said elongated bench, and an upper elongated portion of said canopy extending above said bench so that said upper portion of said elongated canopy, a front portion of said left frame, and a front portion of said right frame define a front facing opening comprising a vertical plane allowing access by one or more athletes to said elongated bench, and so that said left edge portion of said canopy is aligned with and in side-by-side relation to said outer peripheral edge portion of said left frame from said front post to said rear portion of said left frame, and said right edge portion of said canopy is aligned with and in side-by-side relation to said outer peripheral edge portion of said right frame from said front post to said rear portion of said left frame; and said elongated canopy being pivotally movable from the raised orientation to a lowered orientation with said lower elongated portion of said elongated canopy extending from said upper portion of said elongated rear frame and said upper elongated portion of said elongated canopy extending below a front portion of said bench and extending adjacent to the ground.

16. The team shelter of claim 15 wherein said canopy is positionable in said second orientation so that access by the one or more athletes into said shelter is inhibited.

17. The team shelter of claim 15 wherein said canopy, and an upper portion of said left frame, and an upper portion of said right frame are covered, and a lower portion of left frame, a lower portion of said right frame, and a lower portion of a rear of said frame structure are uncovered.

18. The team shelter of claim 15 further comprising a locking device for locking said elongated cover to at least one said front portion of said left frame and said front portion of said right frame when said elongated canopy is positioned in said lowered orientation.

19. The team shelter of claim 15 further comprising a first releasable pin for releasably coupling said left frame to a left side portion of said elongated canopy when said elongated canopy is positioned in said raised orientation, and a second releasable pin for releasably coupling said right frame to a right side portion of said elongated canopy when said elongated canopy is positioned in said lowered orientation.

20. The team shelter of claim 15 further comprising a first toggle latch for biasing a first pin in a first direction into engagement in a first aperture for releasably coupling said left frame to a left side portion of said elongated canopy when said elongated canopy is positioned in said raised orientation, and a second toggle latch for biasing a second pin in a second direction into engagement in a second aperture for releasably coupling said right frame to a right side portion of said elongated canopy when said elongated canopy is positioned in said lowered orientation.

21. The team shelter of claim 20 further comprising a first spring for normally biasing said first pin in a direction opposite from said first direction, and a second spring for normally biasing said second pin in a direction opposite from said second direction.

22. The team shelter of claim 15 further comprising at least one biasing member for biasingly lowering said elongated canopy from said raised orientation to said lowered orientation, and/or for biasingly raising said elongated canopy from said lowered orientation to said raised orientation.

23. The team shelter of claim 15 wherein said left frame comprises at least one rigid solid panel, said right frame comprises at least one rigid solid panel, and said elongated canopy comprises as least one rigid solid panel.

24. The team shelter of claim 15 wherein a bottom portion of said left frame, a bottom portion of said right frame, and said elongated rear frame are uncovered.

25. The team shelter of claim 15 wherein said elongated canopy having a curved cross-section across a width of said elongated canopy.

26. The team shelter of claim 15 further comprising:

a first mobility device attachable to said bottom frame adjacent to said left frame;

a second mobility device attachable to said bottom frame adjacent to said right frame, and said first mobility device and said second mobility device operable for use in moving said shelter; and a removable towing bar storable under said bench, said removable towing bar releasably attachable to said left frame for use in moving said shelter from one location to another and/or to said right frame for use in moving said shelter from one location to another.

27. A method comprising:

providing the shelter of claim 15 with the elongated canopy positioned in the raised orientation; and moving the elongated canopy to the lowered orientation.

28. The method of claim 27 further comprising:

locking said elongated canopy in said lowered orientation.

29. A shelter comprising:

a frame structure comprising a left frame and a spaced-apart right frame;

a canopy;

said canopy positionable in a first position with a front portion of said canopy disposed at a first elevation between a front portion of said left frame and a front portion of said right frame so that said front portion of said canopy, said front portion of said left frame, and said front portion of said right frame define a front facing opening allowing access by one or more people into said shelter and under said canopy;

said canopy positionable in a second position with said front portion of said canopy disposed at a second lower elevation relative to said left frame and said right frame so that said canopy disposed in said second position results in said shelter being less susceptible to wind induced tip over compared to said shelter with said canopy disposed in said first position;

a first device attachable to said left frame;

a second device attachable to said right frame, and said first device and said second device operable for use in moving said shelter; and a towing bar attachable to said left frame for use in moving said shelter from one location to another and/or to said right frame for use in moving said shelter from one location to another; and wherein when said canopy is disposed in said first position contours of a left edge portion of said canopy and an outer peripheral edge portion of said left frame are correspondingly aligned in side-by-side relation, and contours of said right edge portion of said canopy and said outer peripheral edge portion of said right frame are correspondingly aligned in side-by-side relation.

30. The shelter of claim 29 wherein said front facing opening comprises a vertical plane.

31. The shelter of claim 30 wherein said canopy is positionable in said second position with said front portion of said canopy extending forward of said lower front portion of said left frame and said lower front portion of said right frame, and with said front portion of said canopy extending adjacent to the ground.

32. The shelter of claim 31 wherein said rear portion of said canopy is pivotally attached to said frame structure in said first position and in said second position.

33. The shelter of claim 32 further comprising an elongated bench attachable between said left frame and said right frame.

* * * * *